US012789056B2

(12) United States Patent
Hettinger et al.

(10) Patent No.: US 12,789,056 B2
(45) Date of Patent: Nov. 10, 2026

(54) GOLF CLUB HEAD INCLUDING REMOVABLE WEIGHT ASSEMBLY

(71) Applicant: Acushnet Company, Fairhaven, MA (US)

(72) Inventors: Ronald K. Hettinger, Oceanside, CA (US); Kevin Tassistro, San Marcos, CA (US); Ryan E. Locke, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 258 days.

(21) Appl. No.: 18/658,832

(22) Filed: May 8, 2024

(65) Prior Publication Data

US 2025/0345672 A1 Nov. 13, 2025

(51) Int. Cl.
*A63B 53/08* (2015.01)
*A63B 53/04* (2015.01)

(52) U.S. Cl.
CPC ..... *A63B 53/08* (2013.01); *A63B 53/0433* (2020.08); *A63B 53/047* (2013.01); *A63B 2053/0479* (2013.01); *A63B 2053/0491* (2013.01)

(58) Field of Classification Search
CPC ..... A63B 2053/0491; A63B 2053/0479
See application file for complete search history.

(56) References Cited

U.S. PATENT DOCUMENTS

| | | | | |
|---|---|---|---|---|
| 645,942 | A | 3/1900 | Cran | |
| 2,155,830 | A | 4/1939 | Howard | |
| 3,199,874 | A | 8/1965 | Blasing | |
| 4,085,934 | A | 4/1978 | Churchward | |
| 5,050,879 | A | 9/1991 | Sun | |
| 6,015,354 | A | 1/2000 | Ahn | |
| 6,277,032 | B1 | 8/2001 | Smith | |
| 6,409,612 | B1 | 6/2002 | Evans | |
| 6,592,468 | B2 * | 7/2003 | Vincent | A63B 53/047 473/345 |
| 6,663,505 | B1 | 12/2003 | Solari | |
| 6,860,818 | B2 | 3/2005 | Mahaffey | |
| 7,108,609 | B2 | 9/2006 | Stites | |
| 7,121,956 | B2 | 10/2006 | Lo | |
| 7,166,041 | B2 | 1/2007 | Evans | |
| 7,410,425 | B2 | 8/2008 | Willett et al. | |
| 7,530,903 | B2 | 5/2009 | Imamoto | |
| 7,611,424 | B2 | 11/2009 | Nagai | |

(Continued)

FOREIGN PATENT DOCUMENTS

| | | |
|---|---|---|
| JP | 01043278 | 2/1989 |
| JP | 2005296582 | 10/2005 |

(Continued)

OTHER PUBLICATIONS

European Search Report for EP Application 22166630.8 mailed Aug. 25, 2022 (12 pages).

*Primary Examiner* — Raeann Gorden
(74) *Attorney, Agent, or Firm* — Mike S. Kim

(57) ABSTRACT

A golf club head including a removable weight assembly is disclosed herein. In accordance with the presently disclosed technology, the golf club head may include a striking face portion, a back portion, and a removable weight assembly. The removable weight assembly may include a removable weight and a cover portion.

18 Claims, 19 Drawing Sheets

(56) References Cited

U.S. PATENT DOCUMENTS

| | | | |
|---|---|---|---|
| 7,704,163 | B2 | 4/2010 | Stites |
| 7,758,451 | B2 | 7/2010 | Liang |
| 7,775,905 | B2 | 8/2010 | Beach |
| 7,806,782 | B2 | 10/2010 | Stites |
| 7,871,339 | B2 | 1/2011 | Sanchez |
| 7,927,231 | B2 | 4/2011 | Sato |
| 8,016,694 | B2 | 9/2011 | Llewellyn |
| 8,043,167 | B2 | 10/2011 | Boyd |
| 8,088,019 | B1 | 1/2012 | Long et al. |
| 8,192,303 | B2 | 6/2012 | Ban |
| 8,202,175 | B2 | 6/2012 | Ban |
| 8,206,243 | B2 | 6/2012 | Stites |
| 8,303,433 | B2 | 11/2012 | Roach |
| 8,444,505 | B2 | 5/2013 | Beach |
| 8,696,491 | B1 | 4/2014 | Myers |
| 8,777,774 | B1 | 7/2014 | Kim et al. |
| 8,790,195 | B1 | 7/2014 | Myers |
| 8,894,506 | B1 | 11/2014 | Myers |
| 8,968,116 | B1 | 3/2015 | Myers |
| 9,180,349 | B1 | 11/2015 | Seluga |
| 9,211,453 | B1 | 12/2015 | Foster |
| 9,259,627 | B1 | 2/2016 | Myers |
| 9,289,660 | B1 | 3/2016 | Myers |
| 9,364,728 | B1 | 6/2016 | Myers |
| 9,440,126 | B2 | 9/2016 | Boyd |
| 9,561,413 | B2 | 2/2017 | Nielson |
| 9,597,561 | B1 | 3/2017 | Seluga |
| 9,597,563 | B2 | 3/2017 | Voshall |
| 9,623,302 | B1 | 4/2017 | Myers |
| 9,636,553 | B1 | 5/2017 | Myers |
| 9,682,296 | B1 | 6/2017 | Myers |
| 9,694,256 | B2 | 7/2017 | Myers |
| 9,694,261 | B2 | 7/2017 | Nunez |
| 9,707,459 | B1 | 7/2017 | Myers |
| 9,731,175 | B1 | 8/2017 | Myers |
| 9,757,630 | B2 | 9/2017 | Mata |
| 9,868,036 | B1 | 1/2018 | Kleinert |
| 9,878,223 | B2 | 1/2018 | Foster |
| 9,937,392 | B2 | 4/2018 | Myers |
| 10,029,161 | B2 | 7/2018 | Knutson |
| 10,065,094 | B2 | 9/2018 | Wallin |
| 10,183,203 | B1 | 1/2019 | Yi |
| 10,188,916 | B2 | 1/2019 | Harbert |
| 10,213,665 | B1 | 2/2019 | Day |
| 10,398,952 | B1 | 9/2019 | Yi |
| 10,543,406 | B2 | 1/2020 | Carter |
| 10,556,161 | B2 | 2/2020 | Jertson |
| 10,576,337 | B2 | 3/2020 | Soracco |
| 10,695,628 | B1 | 6/2020 | Yi |
| 10,918,917 | B2 | 2/2021 | Northcutt |
| 10,926,143 | B2 | 2/2021 | Bennett |
| 11,013,965 | B2 | 5/2021 | Story |
| 11,090,536 | B2 | 8/2021 | Bennett |
| 11,229,827 | B2 | 1/2022 | Yi |
| 11,439,877 | B2 | 9/2022 | Northcutt |
| 11,439,878 | B2 | 9/2022 | Bennett |
| 11,439,879 | B2 | 9/2022 | Yi |
| 11,497,974 | B2 | 11/2022 | Northcutt |
| 2006/0122004 | A1 | 6/2006 | Chen |
| 2007/0135231 | A1 | 6/2007 | Lo |
| 2008/0020861 | A1 | 1/2008 | Adams |
| 2008/0261715 | A1 | 10/2008 | Carter |
| 2010/0075773 | A1 | 3/2010 | Casati, Jr. |
| 2015/0306473 | A1 | 10/2015 | Breier |
| 2015/0306475 | A1 | 10/2015 | Curtis |
| 2015/0321055 | A1 | 11/2015 | Golden |
| 2016/0271464 | A1 | 9/2016 | Murphy |
| 2018/0056154 | A1 | 3/2018 | Wallin |
| 2018/0065005 | A1 | 3/2018 | Cleghorn |
| 2019/0022481 | A1 | 1/2019 | Mine |
| 2019/0105544 | A1 | 4/2019 | Carter |
| 2020/0330834 | A1 | 10/2020 | Northcutt |
| 2020/0330835 | A1 | 10/2020 | Bennett |
| 2020/0330836 | A1 | 10/2020 | Bennett |
| 2021/0128994 | A1 | 5/2021 | Yi |
| 2021/0138318 | A1 | 5/2021 | Northcutt |
| 2021/0138319 | A1 | 5/2021 | Bennett |
| 2023/0072814 | A1* | 3/2023 | Hettinger ..... A63B 53/04 |
| 2023/0330499 | A1 | 10/2023 | Yi |
| 2024/0066366 | A1 | 2/2024 | Yi |
| 2024/0066368 | A1 | 2/2024 | Ines |

FOREIGN PATENT DOCUMENTS

| | | |
|---|---|---|
| JP | 2005323978 | 11/2005 |
| JP | 2006320493 | 11/2006 |
| JP | 2010069106 | 4/2010 |
| JP | 2010136772 | 6/2010 |
| JP | 2010148702 | 7/2010 |
| JP | 2010252964 | 11/2010 |
| JP | 2012125291 | 7/2012 |
| JP | 2012139450 | 7/2012 |
| JP | 2014223548 | 12/2014 |
| JP | 2021151381 | 9/2021 |

* cited by examiner

GOLF CLUB HEAD INCLUDING REMOVABLE WEIGHT ASSEMBLY

FIELD OF THE DISCLOSURE

The present disclosure generally relates to golf club heads, and more specifically to a golf club head including a removable weight assembly.

SUMMARY

Embodiments of the presently disclosed technology may include golf club heads. In accordance with some aspects of the presently disclosed technology, a golf club head may include a striking face portion, a back portion, and a removable weight assembly. The back portion may include an upper blade portion extending backward from an upper portion of the striking face portion, a gutter extending downward from the upper blade portion, and a lower muscle portion extending downward from the gutter. The lower muscle portion may include a back flange and a sole connecting a lower portion of the striking face portion to the back flange. The back flange may include a removable weight assembly recess and a weight recess. The removable weight assembly may include a removable weight to fit into the removable weight assembly recess and a cover portion to at least partially cover the removable weight assembly recess in a locked configuration. The cover portion may include a cover opening.

In embodiments, the sole may further include a fastening recess. The golf club head may further include a fastening mechanism to fit into the fastening recess. The fastening mechanism may be configured to secure the cover portion in the locked configuration thereby securing the removable weight.

In embodiments, the fastening recess may include a fastening recess axis along which the fastening mechanism is fastened. The weight recess may include a weight recess axis along which the removable weight is placed. The fastening recess axis and the weight recess axis may be substantially parallel.

In embodiments, the removable weight may include a metal.

In embodiments, the metal may be one of a tungsten, steel, titanium, and aluminum.

In embodiments, the removable weight is a flat weight.

In embodiments, the cover portion may be flush with surrounding portions of the golf club head in the locked configuration thereby providing a virtually indistinguishable golf club head from a traditional golf club head.

In embodiments, the weight recess may include a protrusion to engage the removable weight thereby preventing rotation of the removable weight in the locked configuration.

In embodiments, the cover portion may include threads to engage with corresponding threads in the weight recess.

In accordance with some aspects of the presently disclosed technology, a golf club head may include a striking face portion, a back portion, and a removable weight assembly. The back portion may include an upper blade portion extending backward from an upper portion of the striking face portion, a gutter extending downward from the upper blade portion, and a lower muscle portion extending downward from the gutter. The lower muscle portion may include a back flange and a sole connecting a lower portion of the striking face portion to the back flange. The back flange may include a removable weight assembly recess, a first weight recess located toeward, and a second weight recess located heelward. The first weight recess may include a first position and a second position to receive a first removable weight. The second weight recess may include a third position and a fourth position to receive the first removable weight. The removable weight assembly may include the first removable weight to fit into one of the first position, the second position, the third position, and the fourth position. The cover portion may at least partially cover the removable weight assembly recess in a locked configuration. The cover portion may include a cover opening.

In embodiments, the sole may further include a fastening recess. The golf club head may further include a fastening mechanism to fit into the fastening recess. The fastening mechanism may be configured to secure the cover portion in the locked configuration thereby securing the first removable weight.

In embodiments, the fastening recess may be located between the first weight recess and the second weight recess.

In embodiments, the removable weight assembly may further include a second removable weight to fit into one of the first position, the second position, the third position, and the fourth position.

In embodiments, the first removable weight and the second removable weight may include a metal.

In embodiments, the metal may be one of a tungsten, steel, titanium, and aluminum.

In embodiments, the first removable weight may be a first weight, and the second removable weight may be a second weight. The first weight may be different from the second weight.

In accordance with some aspects of the presently disclosed technology, a golf club head may include a striking face portion, a back portion, and a removable weight assembly. The back portion may include an upper blade portion extending backward from an upper portion of the striking face portion, a gutter extending downward from the upper blade portion, and a lower muscle portion extending downward from the gutter. The lower muscle portion may include a back flange and a sole connecting a lower portion of the striking face portion to the back flange. The back flange may include a removable weight assembly recess and a weight recess. The removable weight assembly may include a removable weight to fit into the weight recess. The removable weight may be cylindrical. The cover portion may at least partially cover the removable weight assembly recess in a locked configuration. The cover portion may be circular. The cover portion may include a cover opening to receive at least a portion of the removable weight and threads to engage with corresponding threads in the weight recess to secure the cover portion to the golf club head.

In embodiments, the weight recess may include a protrusion to engage the removable weight thereby preventing rotation of the removable weight in the locked configuration.

In embodiments, the removable weight may include a recessed groove to engage the protrusion.

In embodiments, the removable weight may include a metal.

Figure 1:
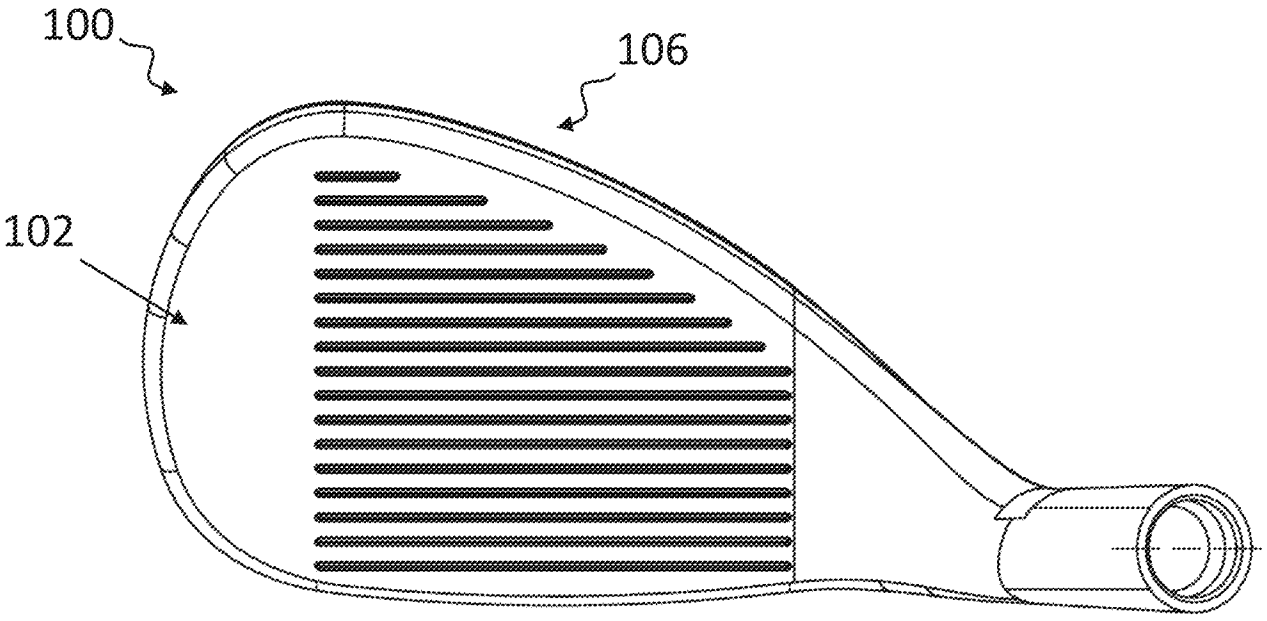
FIG. 1 is a perspective view of a golf club head in accordance with one or more embodiments of the presently disclosed technology.

These and other features of the presently disclosed technology, as well as the methods of operation and functions of the related elements of structure and the combination of parts, may be clearer upon consideration of the following detailed description and the claims with reference to these drawings, all of which form a part of this specification, with like reference numerals designating corresponding parts in the various figures. It is to be expressly understood that these drawings are for illustration purposes and description and are not intended to be limiting. It should be noted that for clarity and ease of illustration these drawings are not necessarily made to scale. As used in the specification and in the claims, the singular form of "a", "an", and "the" may include plural referents unless the context clearly dictates otherwise.

DETAILED DESCRIPTION

Currently, there are limited techniques to dynamically adjust a weight of a golf club iron and/or golf club wedge. Of the limited techniques, many are permanent and/or time-consuming. For example, these may include drilling holes into hosels, back flanges, or other components of golf club heads, polishing off material on the golf club head, and/or adding lead tape or tip plugs. The presently disclosed technology may allow a golf club head to be dynamically adjustable in swing weight, mass, center of gravity (CG), and/or moment of inertia (MOI). The presently disclosed technology may include a removable weight assembly. The presently disclosed technology may eliminate the need to remove or add material to the golf club head during assembly to meet customization requirements. This may provide dynamic fine tuning of the swing weight, mass, CG, and/or MOI of the golf club head after manufacturing by using the removable weight assembly.

The presently disclosed technology is directed to a golf club head. The golf club head may include a striking face portion, a back portion, and/or a removable weight assembly. The removable weight assembly may be used to adjust characteristics of the golf club head. For example, the golf club head may include components to adjust the swing weight of the golf club head, the CG of the golf club head, the mass of the golf club head, the MOI of the golf club head, the materials of the golf club head, the aesthetics of the golf club head, and/or other characteristics. The presently disclosed technology may allow a user to quickly and easily modify the characteristics of a manufactured golf club head depending on the user's needs by changing and/or adjusting components of the golf club head.

Establishing a reference coordinate system for the presently disclosed technology, an x-axis may refer to the axis that is horizontal to the face from a heel-to-toe direction, a y-axis may refer to the vertical axis through the club in a crown to sole direction, a z-axis may refer to the horizontal axis that is horizontal front to back in a forward and rear direction. Alternatively speaking, the x-axis may be defined as a horizontal axis tangent to a geometric center of the face with the positive direction towards a heel of the golf club head, a y-axis is a vertical axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions. For example, the x-y-z coordinate system may be used to describe the CG of the golf club head. The golf club head may have a CG-x, a CG-y, and a CG-z component corresponding to the x-, y-, and z-coordinates discussed herein.

Figure 2:
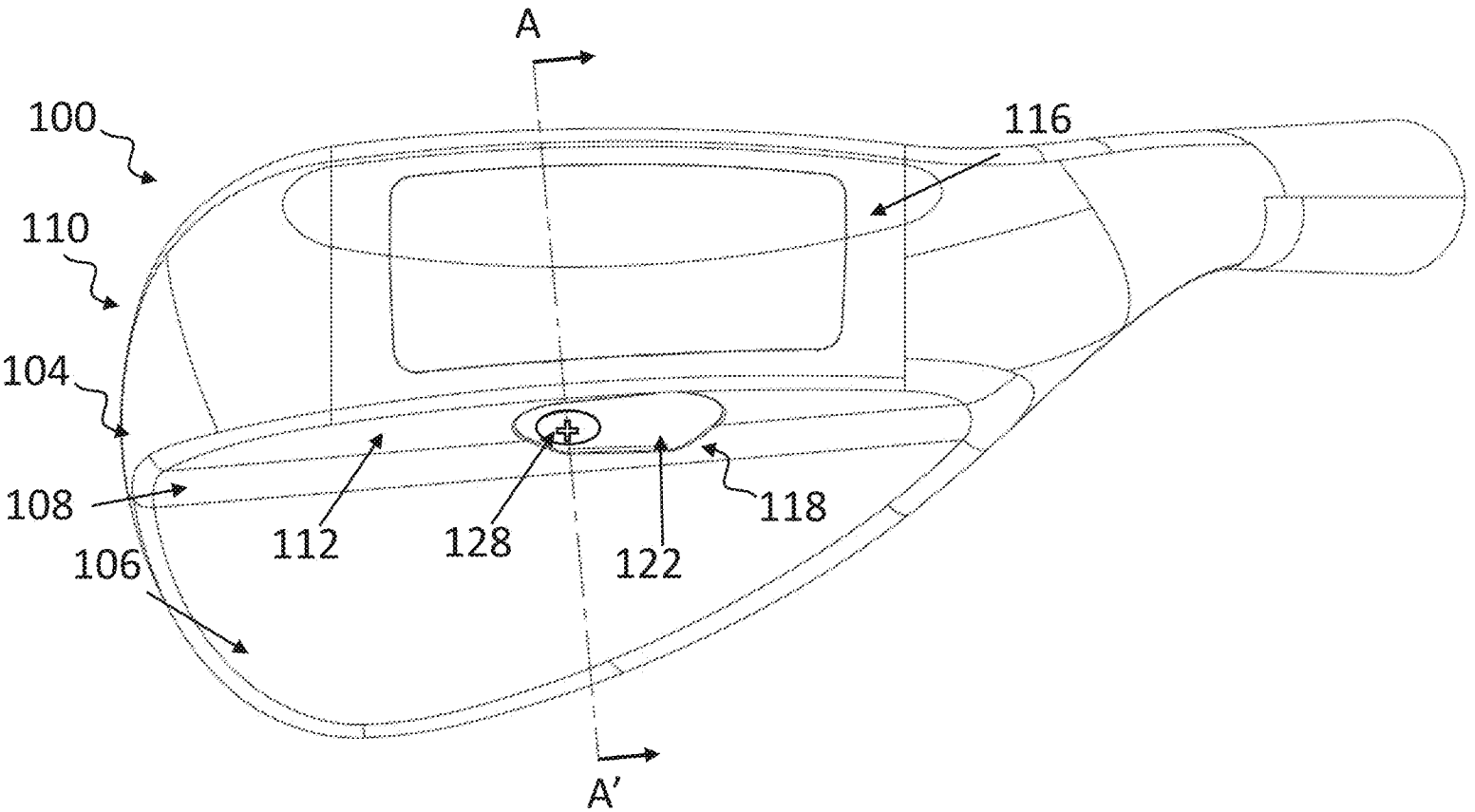
FIG. 2 is a rear view of a golf club head in accordance with one or more embodiments of the presently disclosed technology.
Figure 3:
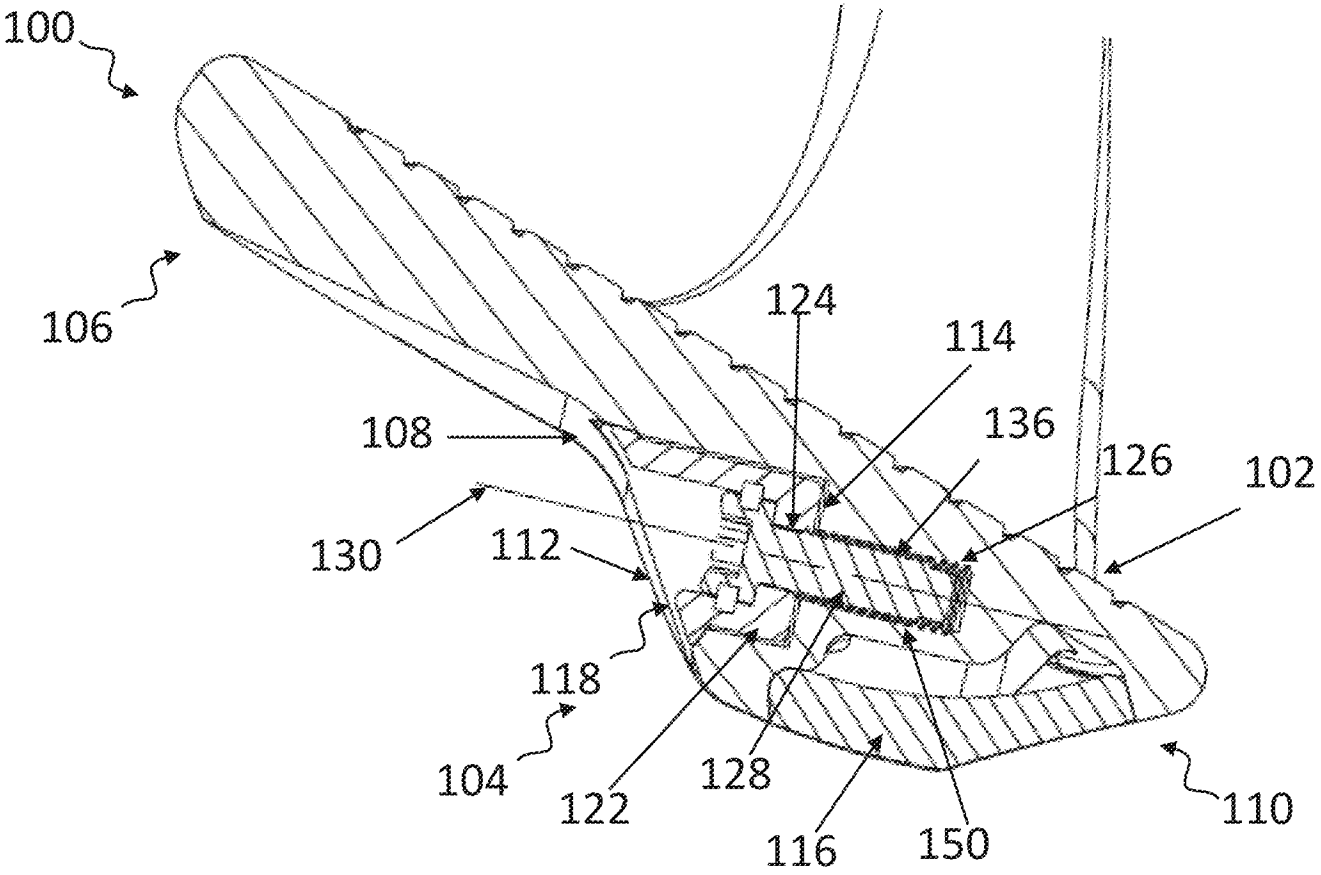
FIG. 3 is a cross-sectional view of a golf club head in accordance with one or more embodiments of the presently disclosed technology taken substantially along line A-A' of FIG. 2.
Figure 4:
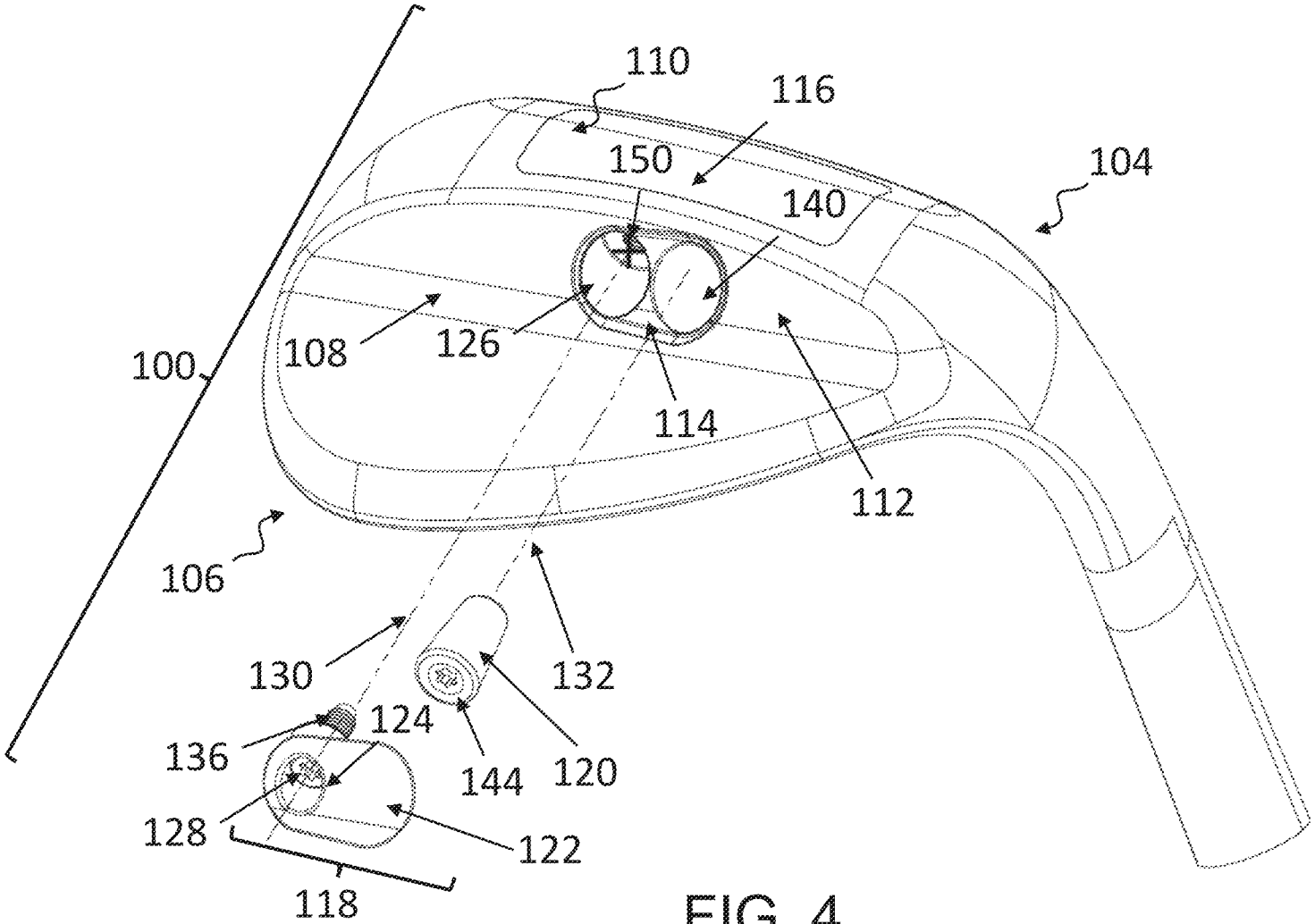
FIG. 4 is an exploded view of a golf club head in accordance with one or more embodiments of the presently disclosed technology.

FIGS. 1-4 illustrate golf club head 100 in accordance with one or more embodiments of the presently disclosed technology. For example, FIG. 1 is a perspective view of golf club head 100 in accordance with one or more embodiments of the presently disclosed technology. FIG. 2 is a rear view of golf club head 100 in accordance with one or more embodiments of the presently disclosed technology. FIG. 3 is a cross-sectional view of golf club head 100 in accordance with one or more embodiments of the presently disclosed technology taken substantially along line A-A' of FIG. 2. FIG. 4 is an exploded view of golf club head 100 in accordance with one or more embodiments of the presently disclosed technology. Each of these figures may provide different views of the same or similar components and may be discussed together herein. Referring first to FIG. 1, golf club head 100 may include striking face portion 102, back portion (at least shown as back portion 104 in FIG. 2), and/or removable weight assembly (at least shown as removable weight assembly 118 in FIG. 2). Striking face portion 102 may refer to a frontal portion of a golf club head 100. Striking face portion 102 may be intended to strike a golf ball. A frontal surface of striking face portion 102 may be substantially planar.

Referring to FIG. 2, back portion 104 may extend backward from an upper portion of striking face portion 102. Back portion 104 may include upper blade portion 106, gutter 108, and/or lower muscle portion 110. Upper blade portion 106 may refer to a blade portion of golf club head 100. Upper blade portion 106 may refer to an upper portion of back portion 104. Upper blade portion 106 may extend backward from at least a top portion of striking face portion 102. Gutter 108 may extend downward from upper blade portion 106. Gutter 108 may be tapered or curved from a bottom of upper blade portion 106 to a top of sole 116. In some embodiments, gutter 108 may be linear. Lower muscle portion 110 may extend downward from gutter 108. Gutter 108 may be a transition between upper blade portion 106 and lower muscle portion 110. Lower muscle portion 110 may refer to a bottom portion of back portion 104. Lower muscle portion 110 may include back flange 112 and/or sole 116. Back flange 112 may extend linearly away from gutter 108. In some embodiments, back flange 112 may extend non-linearly away from gutter 108. In one example, back flange 112 may extend diagonally away from gutter 108 in a backward and downward direction.

Referring to FIG. 3, gutter 108, back flange 112, and/or sole 116 may include removable weight assembly recess 114, weight recess (at least shown as weight recess 140 in FIG. 4), and/or fastening recess (at least shown as fastening recess 126 in FIG. 4). Removable weight assembly recess 114 may receive at least a portion of removable weight assembly 118. Removable weight assembly recess 114 may appear substantially rectangular looking directly into a bottom of removable weight assembly recess 114. Substantially along the cross-section line A-A', removable weight assembly recess 114 may appear substantially rectangular along a bottom of removable weight assembly recess 114. It should be appreciated that removable weight assembly recess 114 may be otherwise shaped, sized, and/or dimensioned without departing from the spirit and scope of the presently disclosed technology. For example, the bottom of removable weight assembly recess 114 may be angled, curved, or otherwise shaped to receive and/or secure one or more components of removable weight assembly 118.

Referring to FIG. 4, weight recess 140 may receive at least a portion of removable weight 120. Weight recess 140 may be heelward on removable weight assembly recess 114 or heelward of fastening recess 126. In some embodiments, weight recess 140 may be toeward on removable weight assembly recess 114 or toeward of fastening recess 126. It should be appreciated that weight recess 140 may be otherwise positioned without departing from the spirit and scope of the presently disclosed technology. For example, weight recess 140 may be forward or backward on removable weight assembly recess 114 or forward or backward of fastening recess 126. Weight recess 140 may be set within removable weight assembly recess 114. For example, removable weight assembly recess 114 may be recessed a first distance. Weight recess 140 may be recessed a second distance. The second distance may be larger than the first distance. In some embodiments, weight recess 140 may be understood as being recessed within removable weight assembly recess 114. It should be appreciated that weight recess 140 may be otherwise shaped, sized, and/or dimensioned without departing from the spirit and scope of the presently disclosed technology. For example, the bottom of weight recess 140 may be angled, curved, or otherwise shaped to receive and/or secure at least a portion of removable weight 120.

Sole 116 may connect a lower portion of striking face portion 102 to back flange 112. Sole 116 may include fastening recess 126 and/or fastening mechanism 128. Fastening recess 126 may receive at least a portion of fastening mechanism 128. Fastening recess 126 may be toeward on removable weight assembly recess 114 or toeward of weight recess 140. In some embodiments, fastening recess 126 may be heelward on removable weight assembly recess 114 or heelward of weight recess 140. It should be appreciated that fastening recess 126 may be otherwise positioned without departing from the spirit and scope of the presently disclosed technology. For example, fastening recess 126 may be forward or backward on removable weight assembly recess 114 or forward or backward of weight recess 140. Fastening recess 126 may be set within removable weight assembly recess 114. For example, removable weight assembly recess 114 may be recessed a first distance. Fastening recess 126 may be recessed a third distance. The third distance may be larger than the first distance. In some embodiments, fastening recess 126 may be understood as being recessed within removable weight assembly recess 114. Fastening recess 126 may include threads 150 in at least part of fastening recess 126. It should be appreciated that fastening recess 126 may be otherwise shaped, sized, and/or dimensioned without departing from the spirit and scope of the presently disclosed technology. For example, the bottom of fastening recess 126 may be angled, curved, or otherwise shaped to receive and/or secure at least a portion of fastening mechanism 128.

Fastening mechanism 128 may be a fastener. Fastening mechanism 128 may include threads 136. Threads 136 may engage threads 150 to secure fastening mechanism 128. The fastener may include a body and a head. The head may be a star-style head, a hexalobular-style head, a Phillips-style head, a slotted-style head, a hexagonal-style head, a square-style head, and/or other head types without departing from the spirit and scope of the presently disclosed technology. Fastening mechanism 128 may secure removable weight assembly 118 to back portion 104. For example, fastening mechanism 128 may secure cover portion 122 and/or removable weight 120 to back portion 104. Fastening mechanism 128 may include fastening recess axis 130. Fastening recess axis 130 may be an axis along which fastening mechanism 128 is fastened into a locked configuration. For example, this axis may be angled with respect to a the plane of striking face portion 102. This weight recess axis angle, a, may be between about 5° and about 80° from the plane of striking face portion 102. In the locked configuration, fastening mechanism 128 may be fully fastened to secure cover portion 122 and/or fastening mechanism 128 to golf club head 100.

Removable weight assembly 118 may fit into removable weight assembly recess 114, fastening recess 126, and/or weight recess 140. Removable weight assembly 118 may go onto portions of gutter 108 and/or lower muscle portion 110. For example, removable weight assembly 118 may go onto gutter 108, back flange 112, and/or sole 116. Removable weight assembly 118 may include removable weight 120 and/or cover portion 122. Removable weight 120 may be cylindrical. Removable weight 120 may be tapered such that a bottom portion is smaller than a top portion. For example, this may be a partial conical shape with a pointed end cut off. It should be appreciated that removable weight 120 may be differently shaped, sized, and/or dimensioned without departing from the spirit and scope of the presently disclosed technology. Removable weight 120 may be shaped, sized, and/or dimensioned to fit into weight recess 140. Removable weight 120 may be between about 3 g to about 20 g. Using different weights for removable weight 120 may provide a center of gravity range along a heel-to-toe direction between about 1.0 mm to about 3.0 mm. Removable weight assembly 118 may include metal, plastic, composite, and/or other materials. The metal may include tungsten, steel, titanium, aluminum, scandium, zinc, nickel, copper, iron, alloys, and/or other metals without departing from the spirit and scope of the presently disclosed technology. The plastic may include thermosets, thermoplastics, and/or other plastics. Composites may include a variety of materials known to those skilled in the art, including for example, graphite, carbon fiber, resins, ceramics, boron fiber, polymers, foams, and so on. Other components of golf club head 100 may be one or more of these materials.

Removable weight 120 may include weight recess axis 132 and/or weight fastening mechanism 144. Weight recess axis 132 may be an axis along which removable weight 120 is secured into the locked configuration. For example, this axis may be angled with respect to a the plane of striking face portion 102. This weight recess axis angle, θ, may be between about 5° and about 80° from the plane of striking face portion 102. Weight recess axis angle θ may be the same as, or substantially similar to, fastening recess axis angle α. In some embodiments, Weight recess axis 132 may be substantially parallel to fastening recess axis 130. Weight fastening mechanism 144 may be a fastener or include a fastener head to secure weight fastening mechanism 144 into the locked configuration. In some embodiments, removable weight 120 may include an opening in the center to receive a portion of a fastener to secure removable weight 120 to sole 116. The opening may be a through hole. In embodiments, the opening may be a blind hole. In such embodiments, weight recess 140 may include threads to help secure removable weight 120 into weight recess 140.

Cover portion 122 may cover at least part of removable weight assembly recess 114, removable weight 120, fastening mechanism 128, and/or weight recess 140 in the locked configuration. Cover portion 122 may be oval shaped as viewed from above, though it should be appreciated that cover portion 122 may be otherwise shaped, sized, and/or dimensioned without departing from the spirit and scope of the presently disclosed technology. Cover portion 122 may fit into removable weight assembly recess 114. Cover portion 122 may be flush with the surrounding portions of golf club head 100 in the locked configuration thereby providing a virtually indistinguishable golf club head from a traditional golf club head. Cover portion 122 may include cover opening 124. Cover opening 124 may receive a portion of fastening mechanism 128. In some embodiments, cover opening 124 may include multiple circumferences. A first circumference may receive a bottom of a head of fastening mechanism 128. A second circumference may receive a portion of a body of fastening mechanism 128. The second circumference may be smaller than the first circumference. A part of cover portion 122 may extend downward near the second circumference to help fit into fastening recess 126. In some embodiments, fastening mechanism 128 may include a c-clip or retaining mechanism to prevent fastening mechanism 128 from being separated from cover portion 122. For example, this may prevent unintended loss of fastening mechanism 128 during disassembly, or while otherwise in an unfastened configuration. Cover opening 124 may expose at least a portion of the removable weight assembly recess 114.

Figure 5:
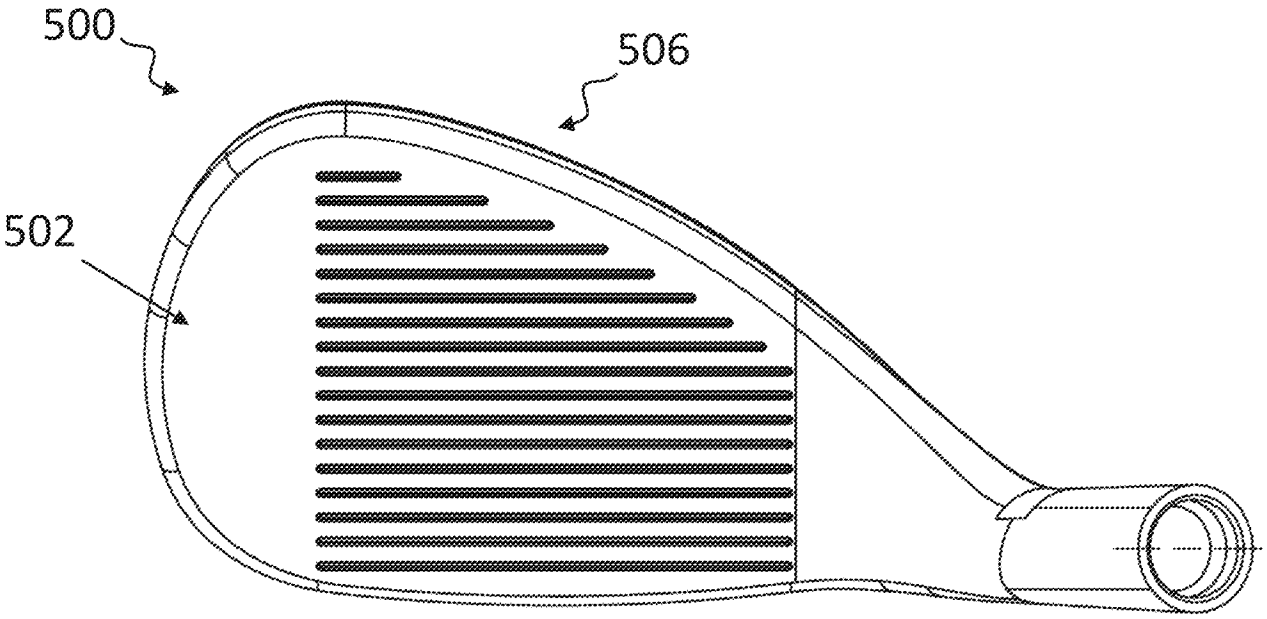
FIG. 5 is a perspective view of a golf club head in accordance with one or more embodiments of the presently disclosed technology.
Figure 6:
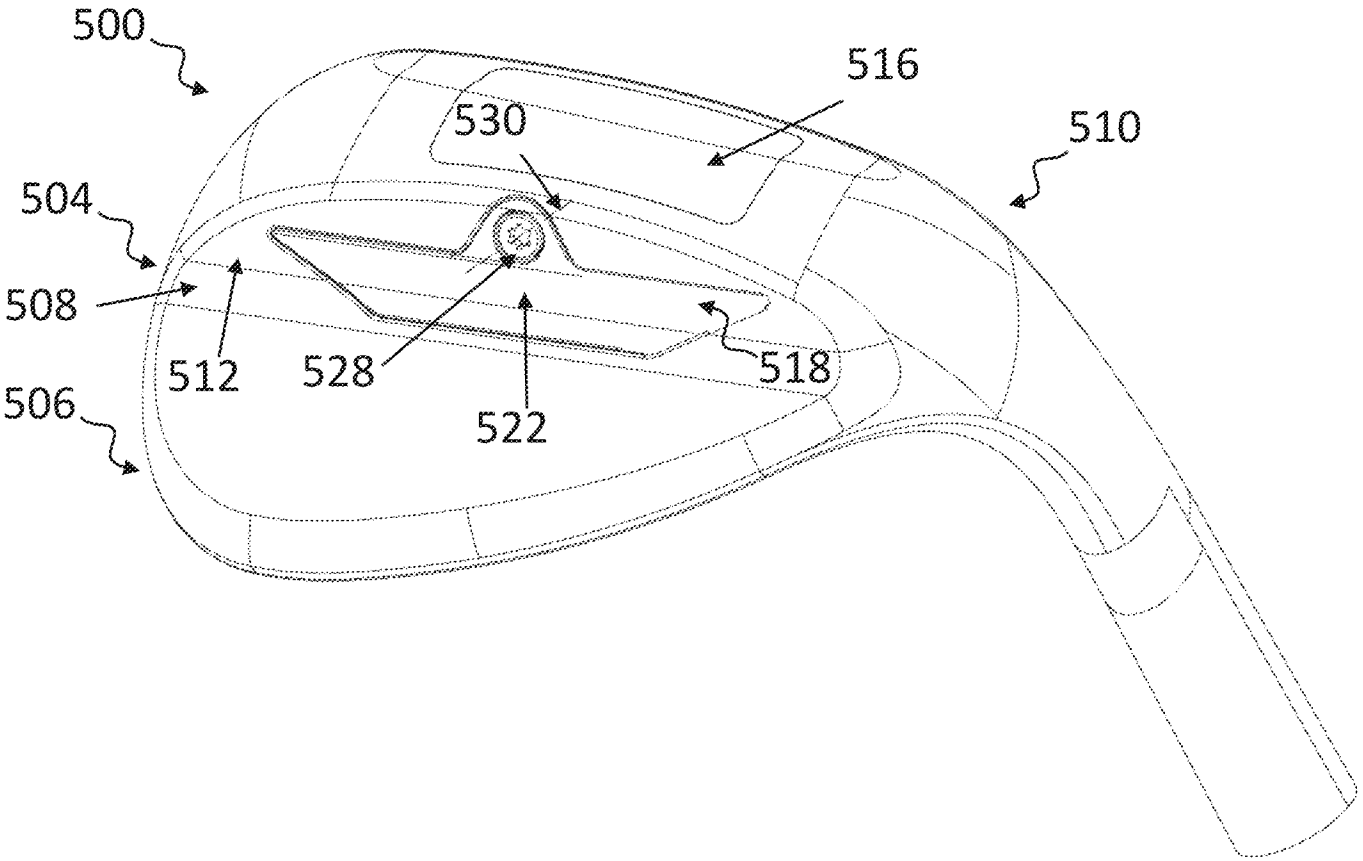
FIG. 6 is a perspective view of a golf club head in accordance with one or more embodiments of the presently disclosed technology.
Figure 7:
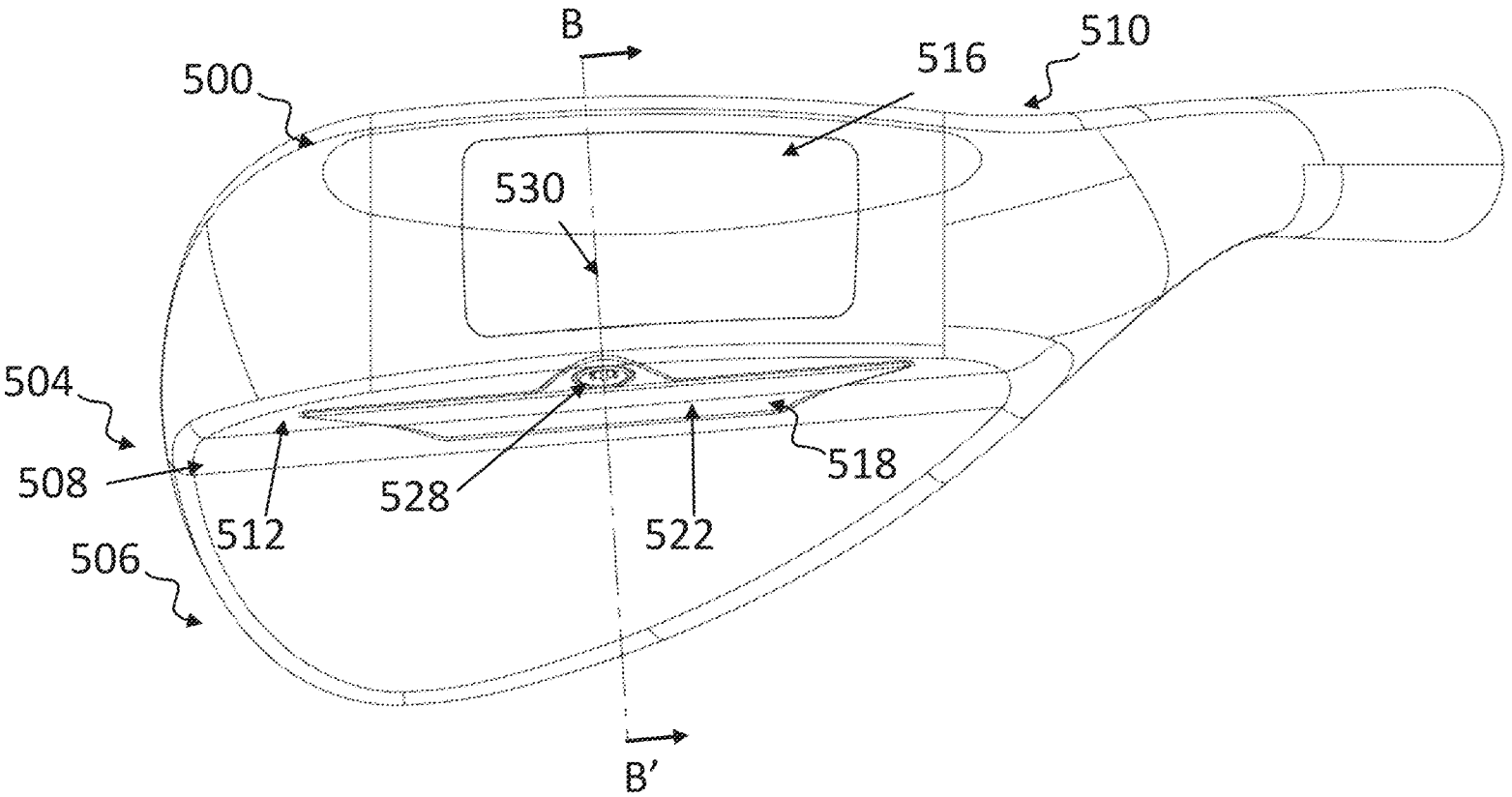
FIG. 7 is a perspective view of a golf club head in accordance with one or more embodiments of the presently disclosed technology.
Figure 8:
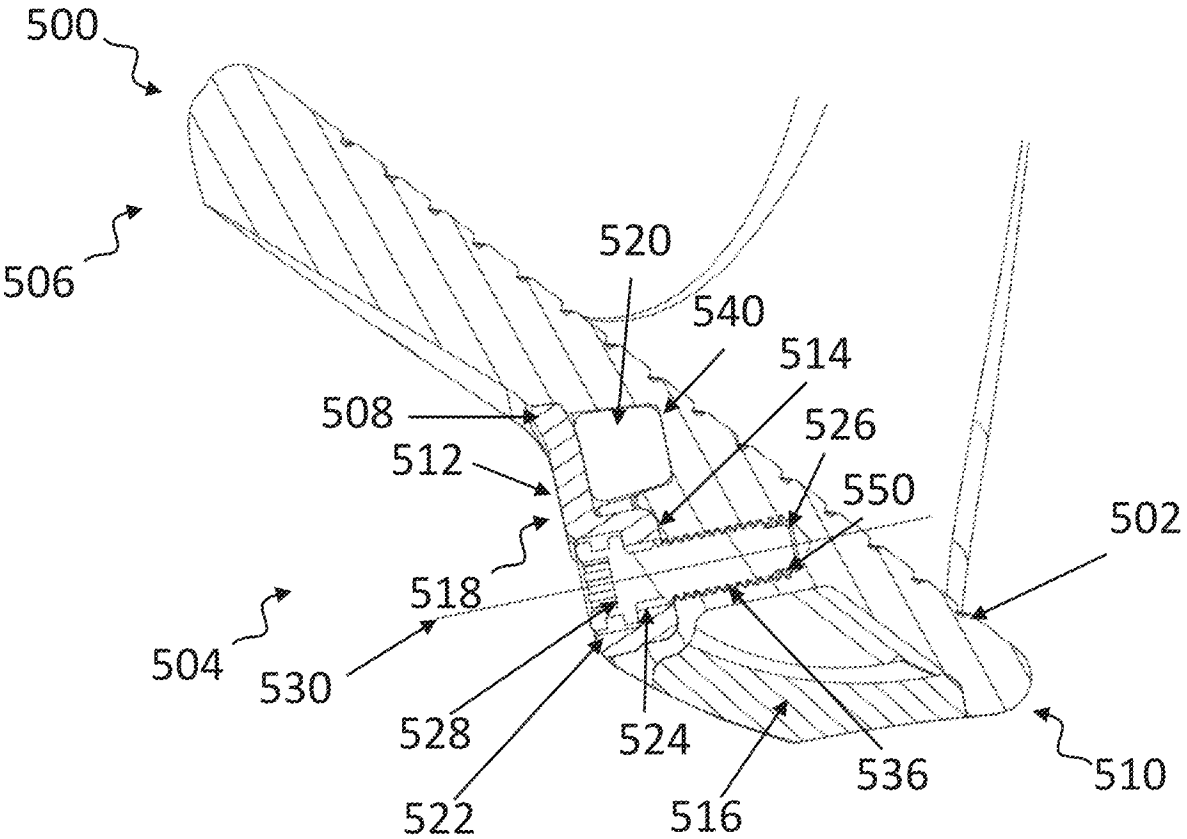
FIG. 8 is a cross-sectional view of a golf club head in accordance with one or more embodiments of the presently disclosed technology taken substantially along line B-B' of FIG. 7.
Figure 9:
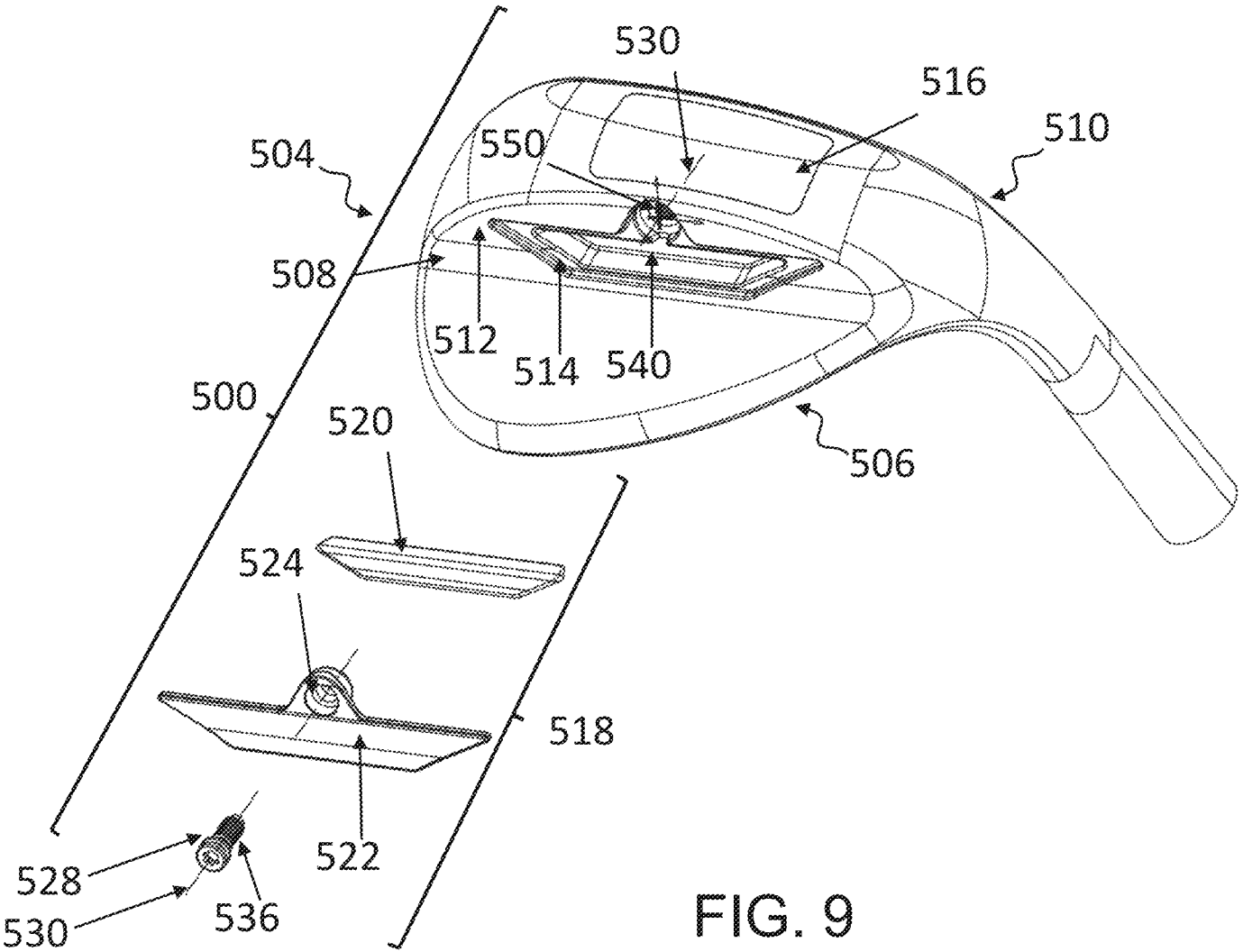
FIG. 9 is an exploded view of a golf club head in accordance with one or more embodiments of the presently disclosed technology.

FIGS. 5-9 illustrate golf club head 500 in accordance with one or more embodiments of the presently disclosed technology. For example, FIG. 5 is a perspective view of golf club head 500 in accordance with one or more embodiments of the presently disclosed technology. FIG. 6 is a perspective view of golf club head 500 in accordance with one or more embodiments of the presently disclosed technology. FIG. 7 is a perspective view of golf club head 500 in accordance with one or more embodiments of the presently disclosed technology. FIG. 8 is a cross-sectional view of golf club head 500 in accordance with one or more embodiments of the presently disclosed technology taken substantially along line B-B' of FIG. 7. FIG. 9 is an exploded view of golf club head 500 in accordance with one or more embodiments of the presently disclosed technology. Each of these figures may provide different views of the same or similar components and may be discussed together herein. Referring first to FIG. 5, golf club head 500 may include striking face portion 502, back portion (at least shown as back portion 504 in FIG. 6), and/or removable weight assembly (at least shown as removable weight assembly 518 in FIG. 6). Striking face portion 502 and/or back portion 504 may be the same as, or substantially similar to, other striking face portions and back portions discussed herein.

Referring to FIG. 6, gutter 508, back flange 512, and/or sole 516 may include removable weight assembly recess 514, weight recess (at least shown as weight recess 540 in FIG. 8), and/or fastening recess (at least shown as fastening recess 526 in FIG. 8). Removable weight assembly recess 514 may receive at least a portion of removable weight assembly 518. Removable weight assembly recess 514 may appear substantially trapezoidal looking directly into a bottom of removable weight assembly recess 514. For example, a front of the trapezoidal shape may be wider than a back of the trapezoidal shape. The sides of the trapezoidal shape may be diagonal. In some embodiments, the sides of the trapezoidal shape may be the same length. In embodiments, the internal angles of the trapezoidal shape may be symmetrical along a top to bottom axis. A front of removable weight assembly recess 514 may be rounded to accommodate fastening mechanism 528. It should be appreciated that removable weight assembly recess 514 may be otherwise shaped, sized, and/or dimensioned without departing from the spirit and scope of the presently disclosed technology. One or more aspects of removable weight assembly recess 514 may be the same as, or substantially similar to, other removable weight assembly recesses discussed herein.

Referring to FIG. 9, weight recess 540 may receive at least a portion of removable weight 520. Weight recess 540 may be centered or substantially centered on removable weight assembly recess 514 or centered or substantially centered upward of fastening recess 526. It should be appreciated that weight recess 540 may be otherwise positioned without departing from the spirit and scope of the presently disclosed technology. For example, weight recess 540 may be heelward, toeward, forward, and/or backward on removable weight assembly recess 514. Weight recess 540 may be set within removable weight assembly recess 514. For example, removable weight assembly recess 514 may be recessed a first distance. Weight recess 540 may be recessed a second distance. The second distance may be larger than the first distance. In some embodiments, weight recess 540 may be understood as being recessed within removable weight assembly recess 514. It should be appreciated that weight recess 540 may be otherwise shaped, sized, and/or dimensioned without departing from the spirit and scope of the presently disclosed technology. For example, the bottom of weight recess 540 may be angled, curved, or otherwise shaped to receive and/or secure at least a portion of removable weight 520. Here, looking into weight recess 540, weight recess 540 may be shaped substantially trapezoidal. In some embodiments, weight recess 540 may have a trapezoidal shape in front of a quadrilateral shape. The quadrilateral shape may have a first width and the sides of the quadrilateral shape may extend diagonally to a second width wider than the first width. The trapezoidal shape may extend diagonally to a third width that is less than the second width. In some embodiments, the third width may be less than the first width. One or more aspects of weight recess 540 may be the same as, or substantially similar to, other removable weight assembly recesses discussed herein.

Sole 516 may be the same as, or substantially similar to, other soles discussed herein. Sole 516 may include fastening recess 526 and/or fastening mechanism 528. Fastening recess 526 may receive at least a portion of fastening mechanism 528. Fastening recess 526 may be centered above removable weight assembly recess 514. It should be appreciated that fastening recess 526 may be otherwise positioned without departing from the spirit and scope of the presently disclosed technology. For example, fastening recess 526 may be heelward of, toeward of, forward of, backward of, and/or within removable weight assembly recess 514. Fastening recess 526 may be set within removable weight assembly recess 514. For example, removable weight assembly recess 514 may be recessed a first distance. Fastening recess 526 may be recessed a third distance. The third distance may be larger than the first distance. In some embodiments, fastening recess 526 may be understood as being recessed within removable weight assembly recess 514. Fastening recess 526 may include threads 550 in at least part of fastening recess 526. It should be appreciated that fastening recess 526 may be otherwise shaped, sized, and/or dimensioned without departing from the spirit and scope of the presently disclosed technology. For example, the bottom of fastening recess 526 may be angled, curved, or otherwise shaped to receive and/or secure at least a portion of fastening mechanism 528. One or more aspects of fastening recess 526 may be the same as, or substantially similar to, other fastening recesses discussed herein.

Fastening mechanism 528, fastening recess axis 530, and/or threads 536 may be the same as, or substantially similar to, other fastening mechanisms, fastening recess axes, and/or threads discussed herein. Removable weight assembly 518 may fit into removable weight assembly recess 514, fastening recess 526, and/or weight recess 540. Removable weight assembly 518 may go onto portions of gutter 508 and/or lower muscle portion 510. For example, removable weight assembly 518 may go onto gutter 508, back flange 512, and/or sole 516. Removable weight assembly 518 may include removable weight 520 and/or cover portion 522. Removable weight 520 may appear substantially trapezoidal looking into removable weight 520 in the locked configuration. In some embodiments, removable weight 520 may have a trapezoidal shape in front of a quadrilateral shape. The quadrilateral shape may have a first width and the sides of the quadrilateral shape may extend diagonally to a second width wider than the first width. The trapezoidal shape may extend diagonally to a third width that is less than the second width. In some embodiments, the third width may be less than the first width. Removable weight 520 may be tapered such that a bottom portion is smaller than a top portion. For example, removable weight 520 may be rectangular substantially along line B-B'. It should be appreciated that removable weight 520 may be differently shaped, sized, and/or dimensioned without departing from the spirit and scope of the presently disclosed technology. Removable weight 520 may be shaped, sized, and/or dimensioned to fit into weight recess 540. Removable weight 520 may be a flat weight. One or more aspects of removable weight assembly 518 and/or removable weight 520 may be the same as, or substantially similar to, other removable weight assemblies and/or removable weights discussed herein.

Cover portion 522 may cover at least part of removable weight assembly recess 514, removable weight 520, fastening mechanism 528, and/or weight recess 540 in the locked configuration. Cover portion 522 may be substantially trapezoidal as viewed from above. For example, a front of the trapezoidal shape may be wider than a back of the trapezoidal shape. The sides of the trapezoidal shape may be diagonal. In some embodiments, the sides of the trapezoidal shape may be the same length. In embodiments, the internal angles of the trapezoidal shape may be symmetrical along a top to bottom axis. It should be appreciated that cover portion 522 may be otherwise shaped, sized, and/or dimensioned without departing from the spirit and scope of the presently disclosed technology. Cover portion 522 may fit into removable weight assembly recess 514. Cover portion 522 may include cover opening 524. Cover opening 524 may receive a portion of fastening mechanism 528. Cover opening 524 may be the same as, or substantially similar to, other cover openings discussed herein. A part of cover portion 522 may extend downward near cover opening 524 to help fit into fastening recess 526. Cover opening 524 may expose at least a portion of the removable weight assembly recess 514. One or more aspects of cover portion 522 may be the same as, or substantially similar to, other cover portions discussed herein.

Referring to FIGS. 7 and 8, additional views of golf club head 500 may provide additional views of golf club head 500, striking face portion 502, back portion 504, upper blade portion 506, gutter 508, lower muscle portion 510, back flange 512, removable weight assembly recess 514, sole 516, removable weight assembly 518, removable weight 520, cover portion 522, cover opening 524, fastening recess 526, fastening mechanism 528, fastening recess axis 530, threads 536, weight recess 540, and/or threads 550.

Figure 10:
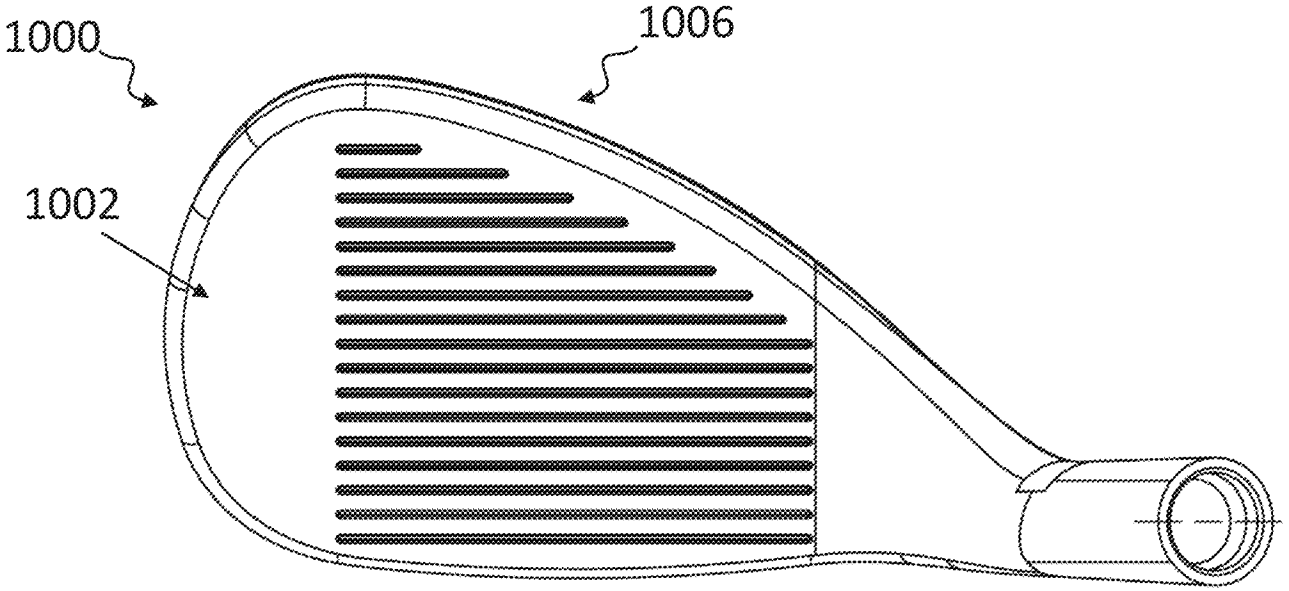
FIG. 10 is a perspective view of a golf club head in accordance with one or more embodiments of the presently disclosed technology.
Figure 11:
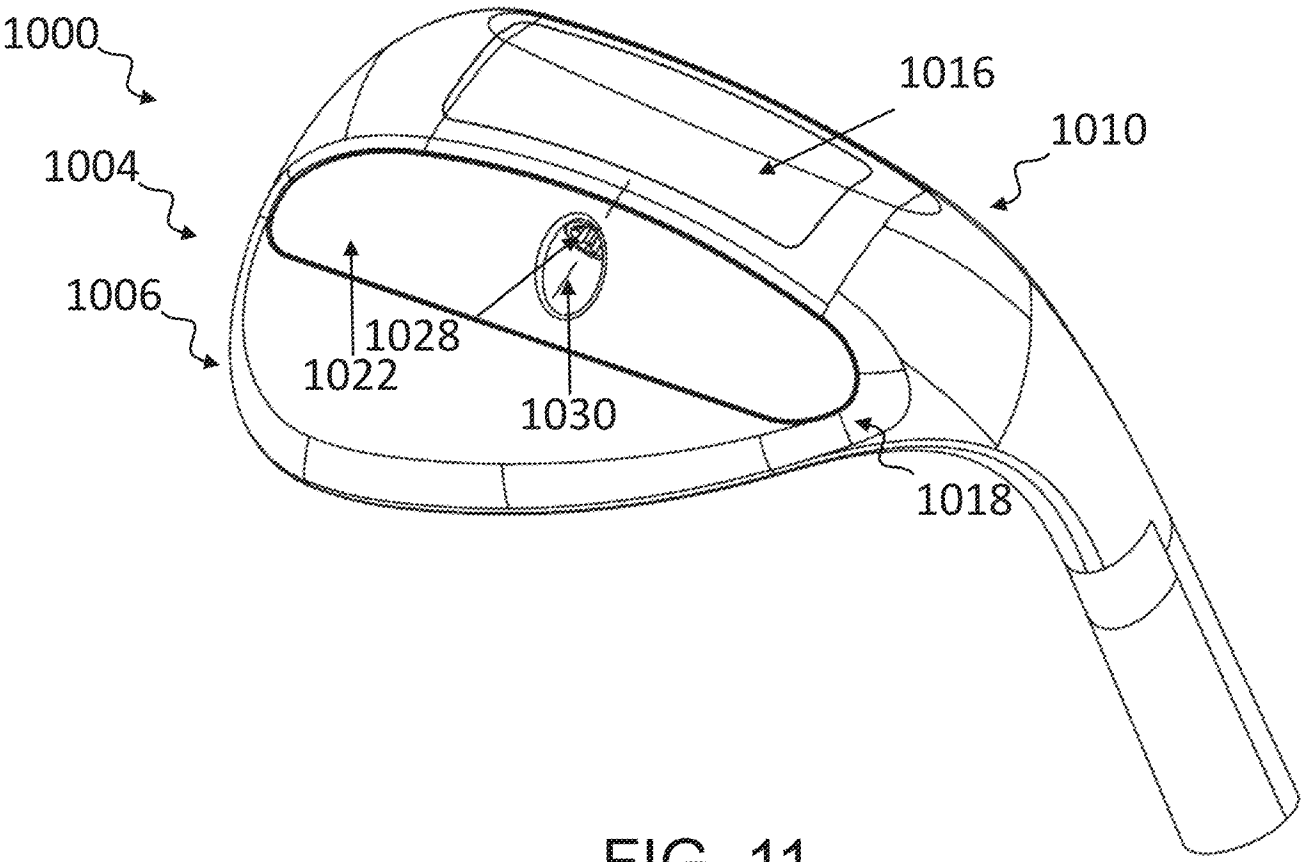
FIG. 11 is a perspective view of a golf club head in accordance with one or more embodiments of the presently disclosed technology.
Figure 12:
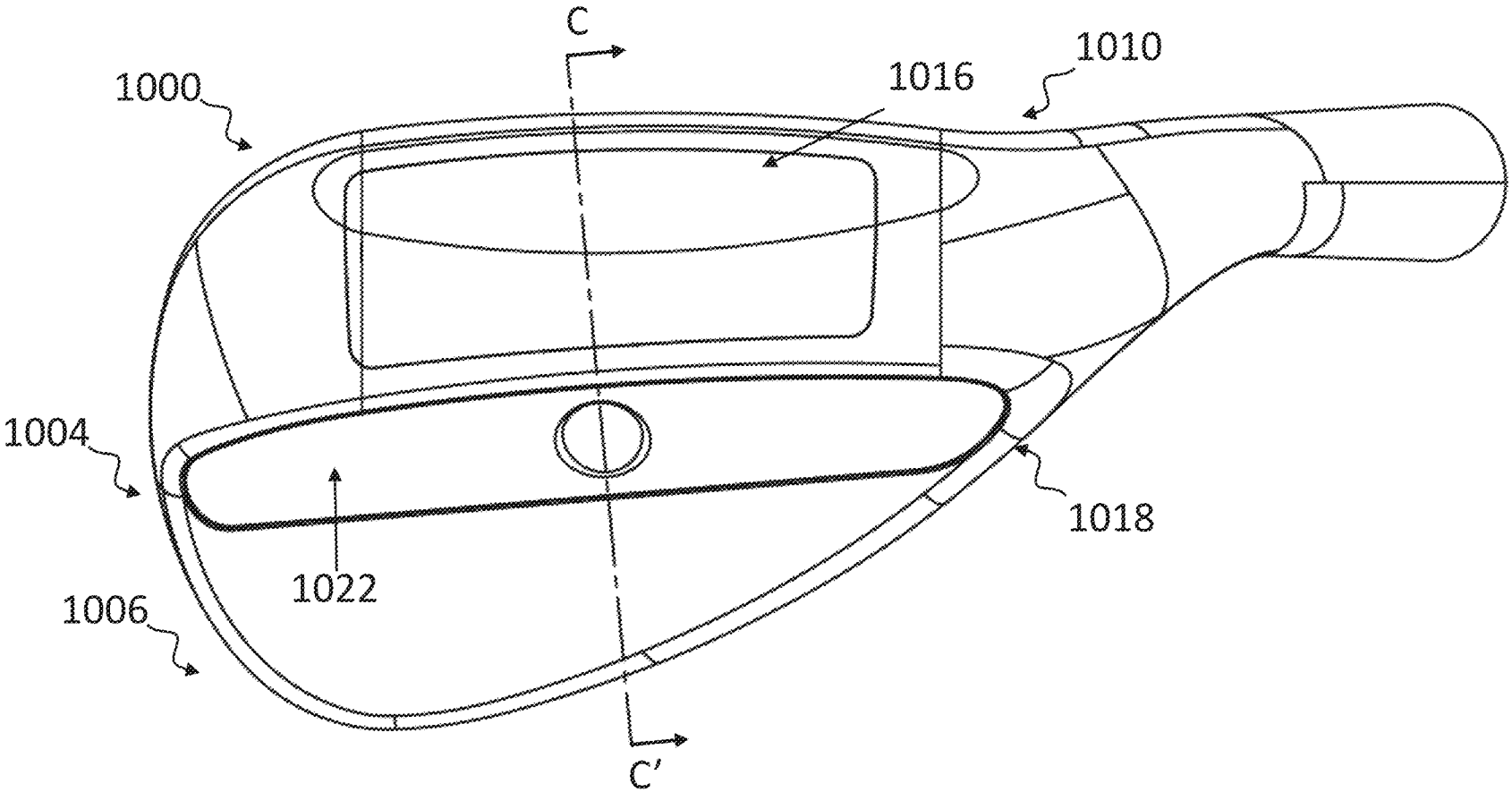
FIG. 12 is a perspective view of a golf club head in accordance with one or more embodiments of the presently disclosed technology.
Figure 13:
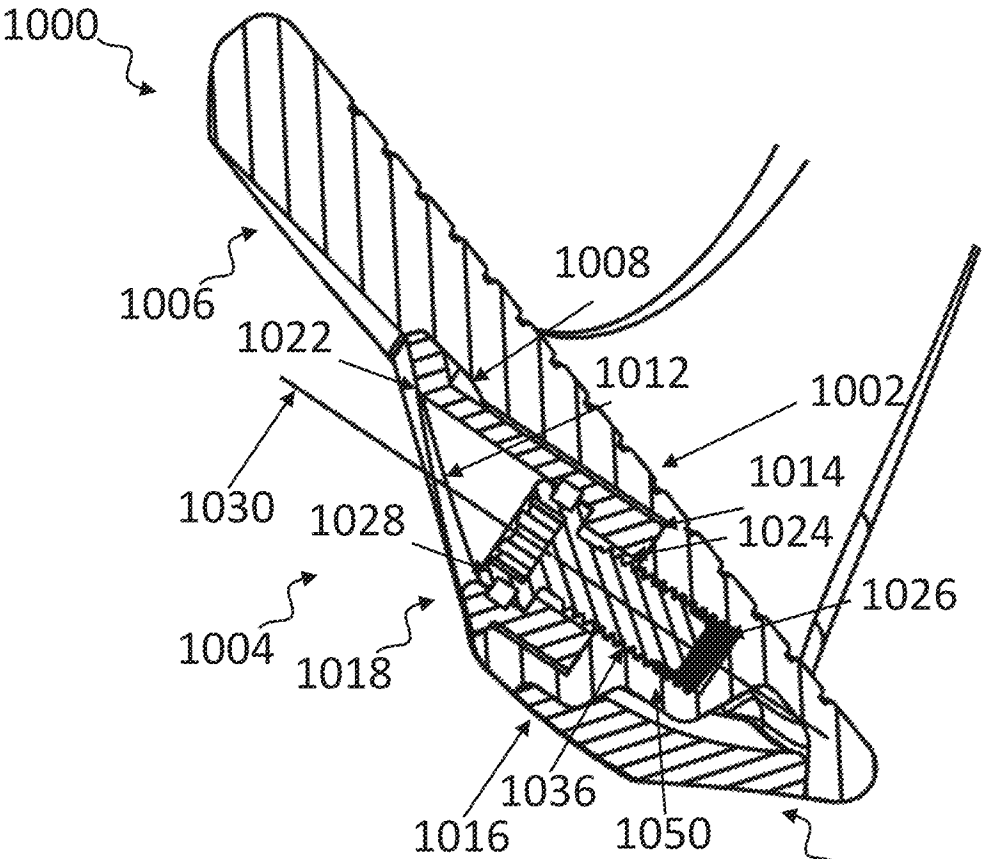
FIG. 13 is a cross-sectional view of a golf club head in accordance with one or more embodiments of the presently disclosed technology taken substantially along line C-C' of FIG. 12.
Figure 14:
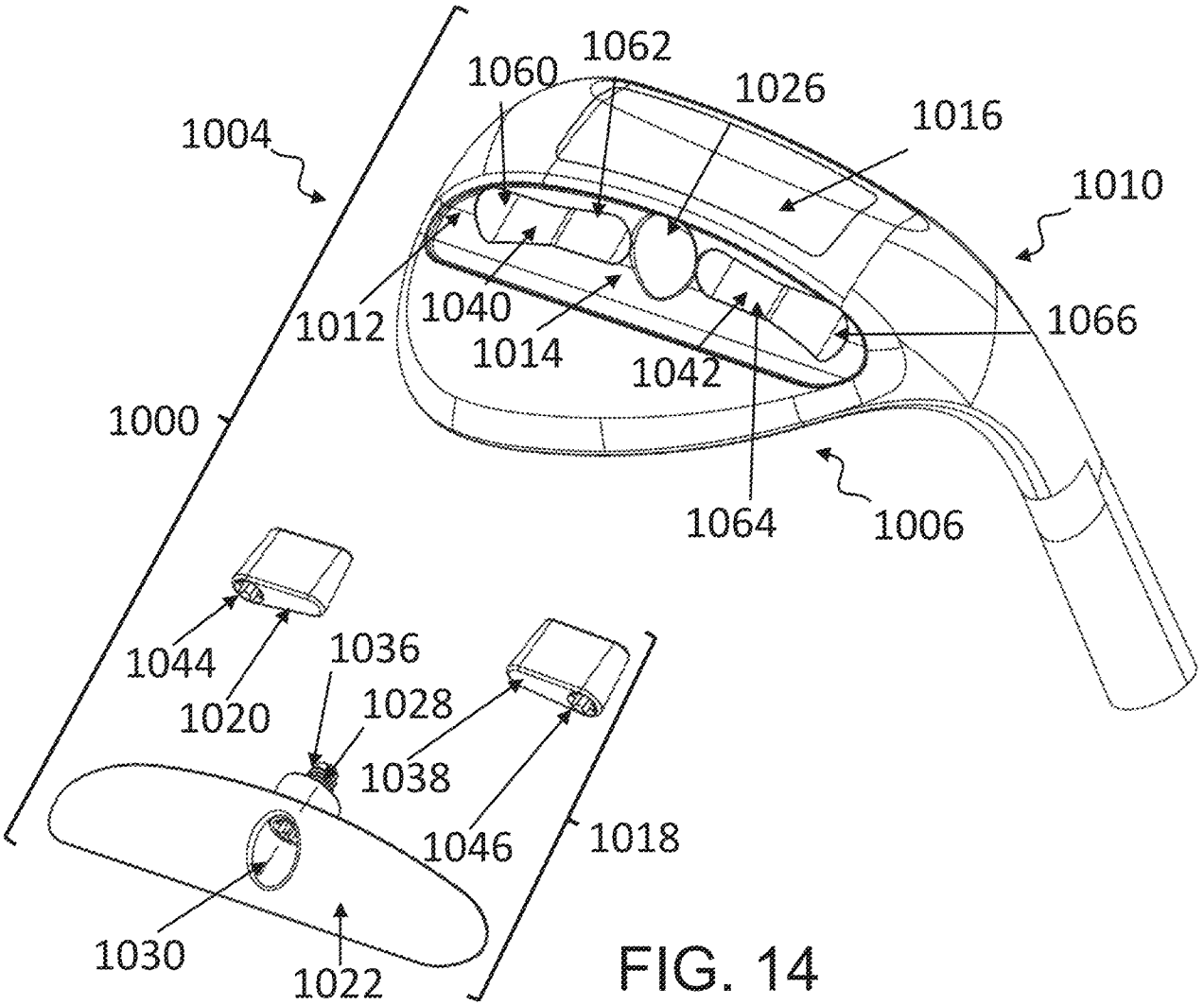
FIG. 14 is an exploded view of a golf club head in accordance with one or more embodiments of the presently disclosed technology.

FIGS. 10-14 illustrate golf club head 1000 in accordance with one or more embodiments of the presently disclosed technology. For example, FIG. 10 is a perspective view of golf club head 1000 in accordance with one or more embodiments of the presently disclosed technology. FIG. 11 is a perspective view of golf club head 1000 in accordance with one or more embodiments of the presently disclosed technology. FIG. 12 is a perspective view of golf club head 1000 in accordance with one or more embodiments of the presently disclosed technology. FIG. 13 is a cross-sectional view of golf club head 1000 in accordance with one or more embodiments of the presently disclosed technology taken substantially along line C-C' of FIG. 12. FIG. 14 is an exploded view of a golf club head in accordance with one or more embodiments of the presently disclosed technology. Each of these figures may provide different views of the same or similar components and may be discussed together herein. Referring first to FIG. 10, golf club head 1000 may include striking face portion 1002, back portion (at least shown as back portion 1004 in FIG. 11), and/or removable weight assembly (at least shown as removable weight assembly 1018 in FIG. 11). Striking face portion 1002 and/or back portion (at least shown as back portion 1004 in FIG. 11) may be the same as, or substantially similar to, other striking face portions and back portions discussed herein.

Referring to FIG. 14, gutter 1008, back flange 1012, and/or sole 1016 may include removable weight assembly recess 1014, first weight recess 1040, second weight recess 1042, and/or fastening recess 1026. Removable weight assembly recess 1014 may receive at least a portion of removable weight assembly 1018. Removable weight assembly recess 1014 may appear substantially ellipse-like looking directly into a bottom of removable weight assembly recess 1014. For example, a first curve may extend across a back, the side curves may be similarly shaped, and the front may be substantially straight. The heelward side may be more curved and the toeward side may be curved, then substantially straight, then curved. It should be appreciated that removable weight assembly recess 1014 may be otherwise shaped, sized, and/or dimensioned without departing from the spirit and scope of the presently disclosed technology. Removable weight assembly recess 1014 may entirely cover back flange 1012 or substantially cover an entire back flange 1012. In some embodiments, removable weight assembly recess 1014 may entirely cover back flange 1012 and/or gutter 1008 or substantially cover an entire back flange 1012 and/or gutter 108. One or more aspects of removable weight assembly recess 1014 may be the same as, or substantially similar to, other removable weight assembly recesses discussed herein.

First weight recess 1040 may receive at least a portion of first removable weight 1020 and/or second removable weight 1038. First weight recess 1040 may include first position 1060 and second position 1062. First position 1060 may be toeward in first weight recess 1040 and second position 1062 may be heelward in first weight recess 1040. First removable weight 1020 may be placed in either first position 1060 and/or second position 1062. In some embodiments, first removable weight 1020 may be placed in one of first position 1060 or second position 1062 and second removable weight 1038 may be placed in the other of first position 1060 or second position 1062. In some embodiments, there may be up to four removable weights placeable into first weight recess 1040 and second weight recess 1042.

First weight recess 1040 may be toeward on removable weight assembly recess 1014 or toeward of fastening recess 1026. In some embodiments, first weight recess 1040 may be heelward on removable weight assembly recess 1014 or heelward of fastening recess 1026. It should be appreciated that first weight recess 1040 may be otherwise positioned without departing from the spirit and scope of the presently disclosed technology. For example, first weight recess 1040 may be forward and/or backward on removable weight assembly recess 1014. First weight recess 1040 may be set within removable weight assembly recess 1014. For example, removable weight assembly recess 1014 may be recessed a first distance. First weight recess 1040 may be recessed a second distance. The second distance may be larger than the first distance. In some embodiments, first weight recess 1040 may be understood as being recessed within removable weight assembly recess 1014. It should be appreciated that first weight recess 1040 may be otherwise shaped, sized, and/or dimensioned without departing from the spirit and scope of the presently disclosed technology. For example, the bottom of first weight recess 1040 may be angled, curved, or otherwise shaped to receive and/or secure at least a portion of first removable weight 1020. Here, looking into first weight recess 1040, first weight recess 1040 may appear substantially bean-shaped, peanut-shaped, bow-tie-shaped, or lemniscate-shaped. These two sections may distinguish first position 1060 and second position 1062. The toe-ward portion may be curved, a first middle portion may narrow linearly, a second middle portion may expand linearly, and a heelward portion may be curved. In some embodiments, first position 1060 and second position 1062 may be solid, such that first position 1060 and second position 1062 may be separated by material of golf club head 1000. In embodiments, as illustrated, first position 1060 and second position 1062 may be open between the positions. In some embodiments, the toeward portion and the heelward portion may be the same or substantially similar, and the first middle portion and the second middle portion may be the same or substantially similar. One or more aspects of first weight recess 1040 may be the same as, or substantially similar to, other weight recesses discussed herein.

Second weight recess 1042 may receive at least a portion of second removable weight 1038 and/or first removable weight 1020. Second weight recess 1042 may include third position 1064 and fourth position 1066. Third position 1064 may be heelward in second weight recess 1042 and fourth position 1066 may be toeward in second weight recess 1042. Second removable weight 1038 may be placed in either third position 1064 and/or fourth position 1066. In some embodiments, second removable weight 1038 may be placed in one of third position 1064 or fourth position 1066 and first removable weight 1020 may be placed in the other of third position 1064 or fourth position 1066. Moving positions of first removable weight 1020 and/or second removable weight 1038 may affect CG, MOI, and/or other characteristics of golf club head 1000. For example, with different weights for first removable weight 1020 and/or second removable weight 1038, a center of gravity range along a heel-to-toe direction, a bottom-to-top direction, and/or a back-to-front direction, between about 1.0 mm to about 5.0 mm. In some embodiments, a weight of first removable weight 1020 may be different than a weight of second removable weight 1038. This may allow further adjustment of CG, MOI, and/or other characteristics of golf club head 1000

Second weight recess 1042 may be heelward on removable weight assembly recess 1014 or heelward of fastening recess 1026. In some embodiments, second weight recess 1042 may be toeward on removable weight assembly recess 1014 or toeward of fastening recess 1026. It should be appreciated that second weight recess 1042 may be otherwise positioned without departing from the spirit and scope of the presently disclosed technology. For example, second weight recess 1042 may be forward and/or backward on removable weight assembly recess 1014. Second weight recess 1042 may be set within removable weight assembly recess 1014. For example, removable weight assembly recess 1014 may be recessed a first distance. Second weight recess 1042 may be recessed a fourth distance. The fourth distance may be larger than the first distance. The fourth distance may be the same as the second distance. In some embodiments, the fourth distance may be different than the second distance. In some embodiments, second weight recess 1042 may be understood as being recessed within removable weight assembly recess 1014. It should be appreciated that second weight recess 1042 may be otherwise shaped, sized, and/or dimensioned without departing from the spirit and scope of the presently disclosed technology. For example, the bottom of second weight recess 1042 may be angled, curved, or otherwise shaped to receive and/or secure at least a portion of first removable weight 1020. Here, looking into second weight recess 1042, second weight recess 1042 may appear substantially bean-shaped, peanut-shaped, bow-tie-shaped, or lemniscate-shaped. These two sections may distinguish third position 1064 and fourth position 1066. The toe-ward portion may be curved, a first middle portion may narrow linearly, a second middle portion may expand linearly, and a heelward portion may be curved. In some embodiments, the toeward portion and the heelward portion may be the same or substantially similar, and the first middle portion and the second middle portion may be the same or substantially similar. One or more aspects of second weight recess 1042 may be the same as, or substantially similar to, other weight recesses discussed herein.

Sole 1016 may be the same as, or substantially similar to, other soles discussed herein. Sole 1016 may include fastening recess 1026 and/or fastening mechanism 1028. Fastening recess 1026 may receive at least a portion of fastening mechanism 1028. Fastening recess 1026 may be centered, or substantially centered, on removable weight assembly recess 1014. In some embodiments, fastening recess 1026 may be between first weight recess 1040 and second weight recess 1042. In embodiments, fastening recess 1026 may be offset backward from a center of removable weight assembly recess 1014. It should be appreciated that fastening recess 1026 may be otherwise positioned without departing from the spirit and scope of the presently disclosed technology. For example, fastening recess 1026 may be heelward, toeward, forward, and/or backward within removable weight assembly recess 1014. Fastening recess 1026 may be set within removable weight assembly recess 1014. For example, removable weight assembly recess 1014 may be recessed a first distance. Fastening recess 1026 may be recessed a third distance. The third distance may be larger than the first distance. The third distance may be the same as, or substantially similar to, the second distance and/or the fourth distance. In some embodiments, the third distance may be different from the first distance, the second distance, and the fourth distance. In some embodiments, fastening recess 1026 may be understood as being recessed within removable weight assembly recess 1014. Fastening recess 1026 may include threads 1050 in at least part of fastening recess 1026. It should be appreciated that fastening recess 1026 may be otherwise shaped, sized, and/or dimensioned without departing from the spirit and scope of the presently disclosed technology. For example, the bottom of fastening recess 1026 may be angled, curved, or otherwise shaped to receive and/or secure at least a portion of fastening mechanism 1028. One or more aspects of fastening recess 1026 may be the same as, or substantially similar to, other fastening recesses discussed herein.

Fastening mechanism 1028, fastening recess axis 1030, and/or threads 1036 may be the same as, or substantially similar to, other fastening mechanisms, fastening recess axes, and/or threads discussed herein. Removable weight assembly 1018 may fit into removable weight assembly recess 1014, fastening recess 1026, first weight recess 1040, and/or second weight recess 1042. Removable weight assembly 1018 may go onto portions of gutter 1008 and/or lower muscle portion 1010. For example, removable weight assembly 1018 may go onto gutter 1008, back flange 1012, and/or sole 1016. Removable weight assembly 1018 may include first removable weight 1020, cover portion 1022, and/or second removable weight 1038. First removable weight 1020 and/or second removable weight 1038 may appear substantially ellipses-like looking above first removable weight 1020 and/or second removable weight 1038. Another way of describing this shape may be like flippers in a pinball game used to knock a pinball around. First removable weight 1020 and/or second removable weight 1038 may be tapered such that a bottom portion is smaller than a top portion. It should be appreciated that first removable weight 1020 and/or second removable weight 1038 may be differently shaped, sized, and/or dimensioned without departing from the spirit and scope of the presently disclosed technology. First removable weight 1020 and/or second removable weight 1038 may be shaped, sized, and/or dimensioned to fit into first weight recess 1040 and/or second weight recess 1042. First removable weight 1020 and/or second removable weight 1038 may include first weight fastening mechanism 1044, and/or second first weight fastening mechanism 1046, respectively, which may be the same as, or substantially similar to, other weight fastening mechanism discussed herein. In some embodiments, these may be offset and off-centered. One or more aspects of removable weight assembly 1018, first removable weight 1020, and/or second removable weight 1038 may be the same as, or substantially similar to, other removable weight assemblies and/or removable weights discussed herein.

Cover portion 1022 may cover at least part of removable weight assembly recess 1014, first removable weight 1020, fastening recess 1026, fastening mechanism 1028, second removable weight 1038, first weight recess 1040, and/or second weight recess 1042 in the locked configuration. Cover portion 1022 may be substantially ellipse-like as viewed from above. For example, a first curve may extend across a back, the side curves may be similarly shaped, and the front may be substantially straight. The heelward side may be more curved and the toeward side may be curved, then substantially straight, then curved. It should be appreciated that cover portion 1022 may be otherwise shaped, sized, and/or dimensioned without departing from the spirit and scope of the presently disclosed technology. Cover portion 1022 may fit into removable weight assembly recess 1014. Cover portion 1022 may include cover opening 1024. Cover opening 1024 may receive a portion of fastening mechanism 1028. Cover opening 1024 may be the same as, or substantially similar to, other cover openings discussed herein. A part of cover portion 1022 may extend downward near cover opening 1024 to help fit into fastening recess 1026. One or more aspects of cover portion 1022 may be the same as, or substantially similar to, other cover portions discussed herein.

Referring to FIGS. 11, 12, and 13, additional views of golf club head 1000 may provide additional views of golf club head 1000, striking face portion 1002, back portion 1004, upper blade portion 1006, gutter 1008, lower muscle portion 1010, back flange 1012, removable weight assembly recess 1014, sole 1016, removable weight assembly 1018, cover portion 1022, cover opening 1024, fastening recess 1026, fastening mechanism 1028, fastening recess axis 1030, threads 1036, and/or threads 1050.

Figure 15:
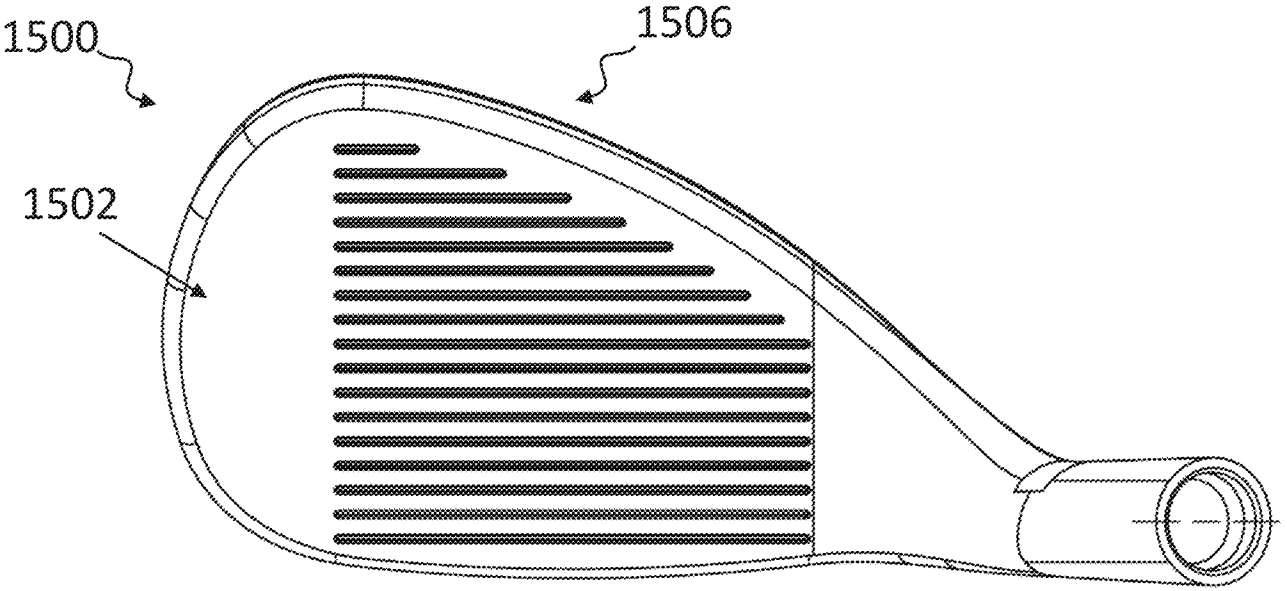
FIG. 15 is a perspective view of a golf club head in accordance with one or more embodiments of the presently disclosed technology.
Figure 16:
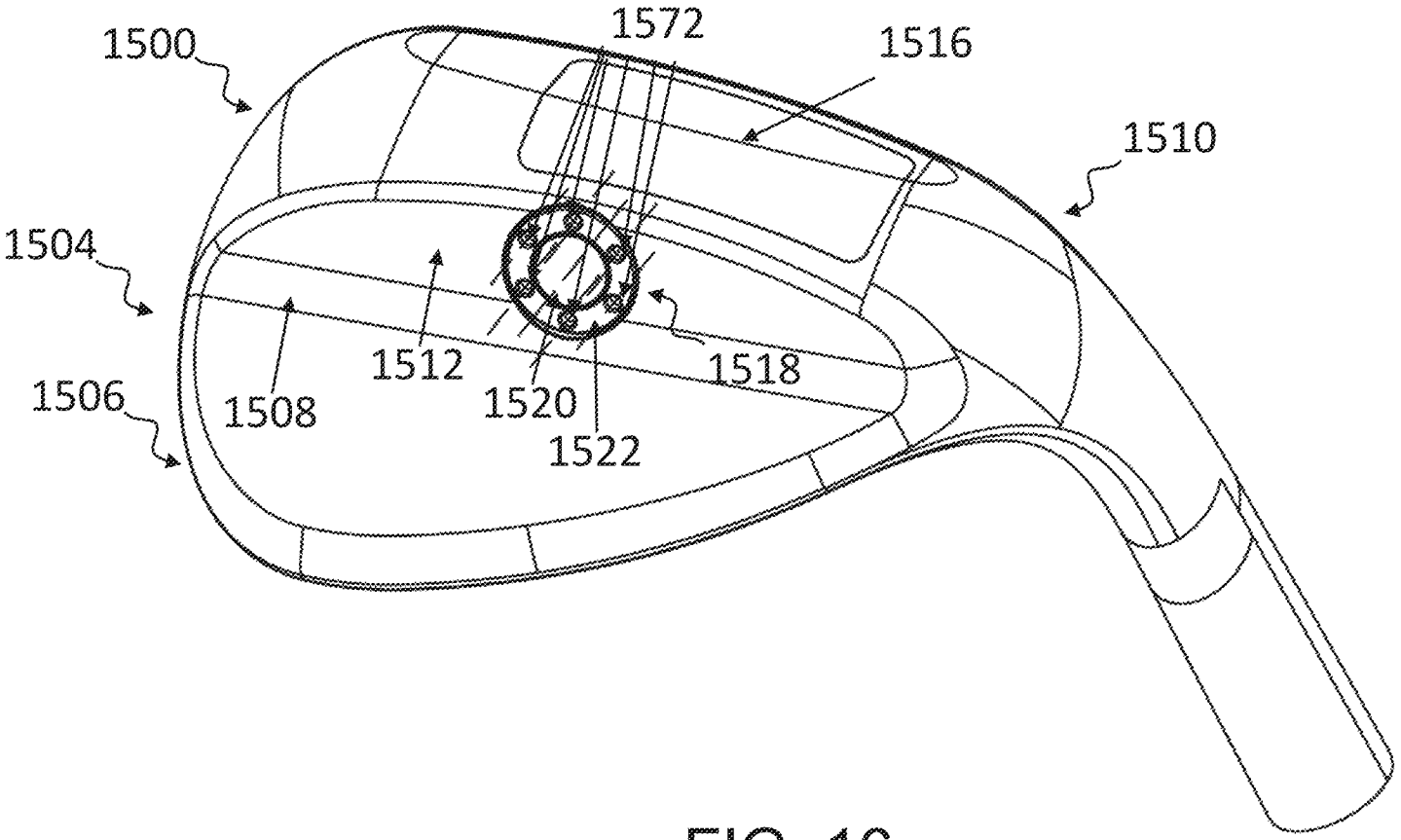
FIG. 16 is a perspective view of a golf club head in accordance with one or more embodiments of the presently disclosed technology.
Figure 17:
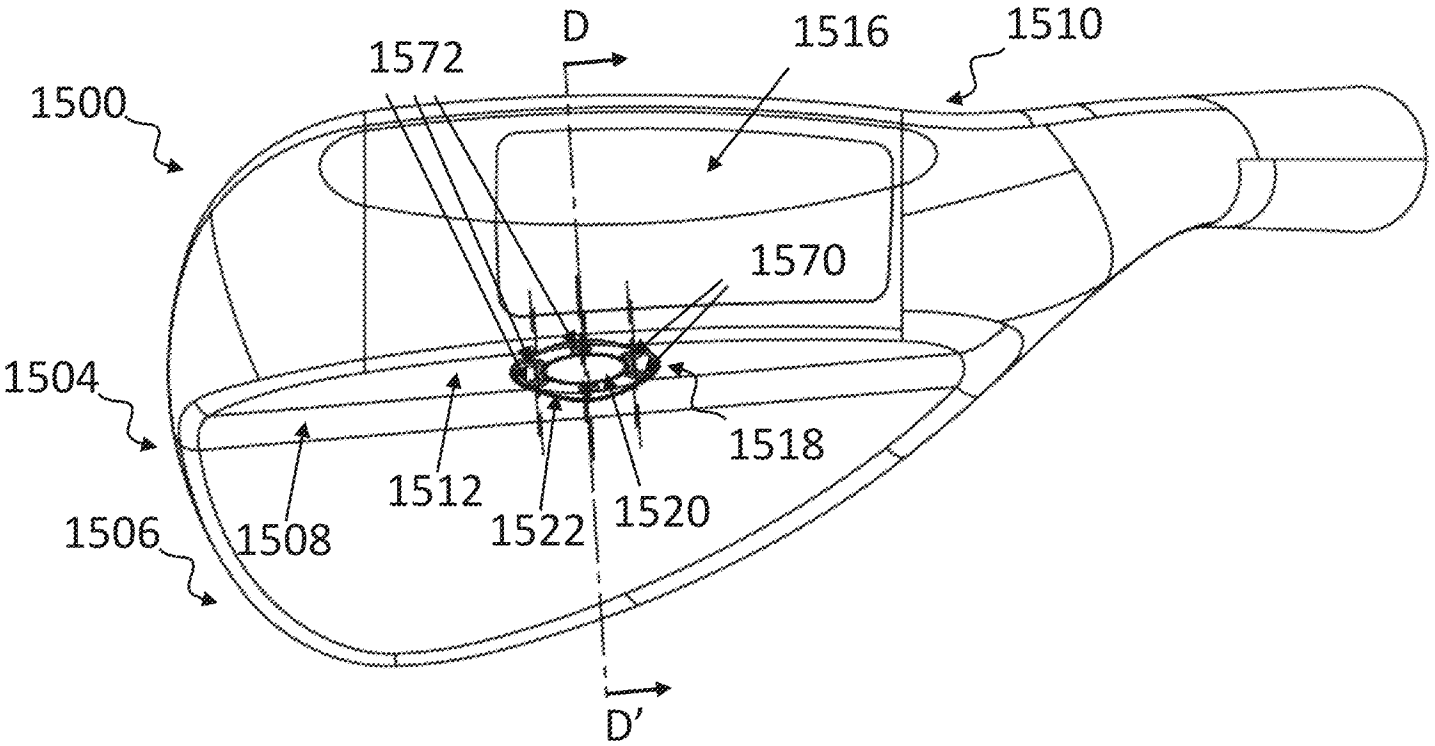
FIG. 17 is a perspective view of a golf club head in accordance with one or more embodiments of the presently disclosed technology.
Figure 18:
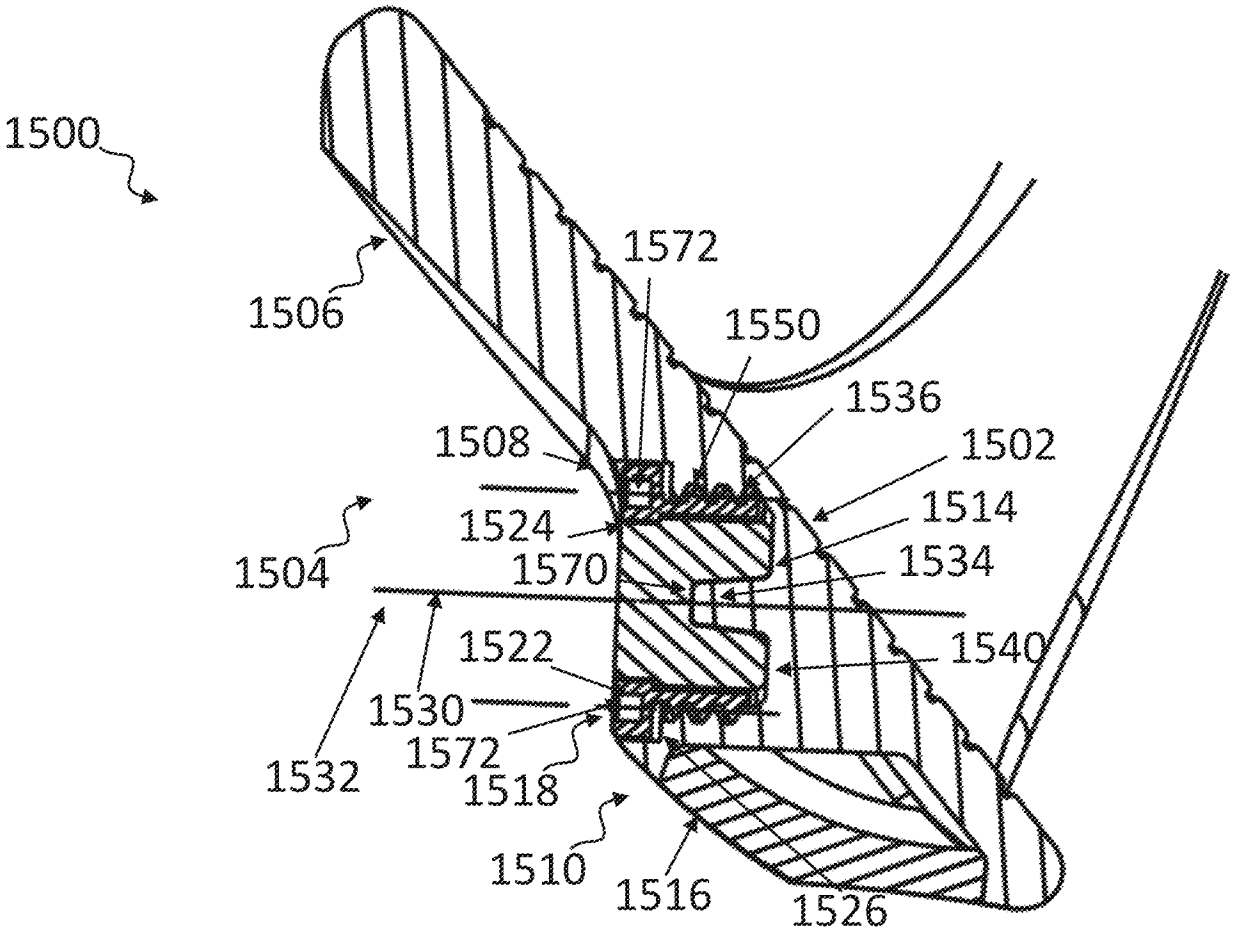
FIG. 18 is a cross-sectional view of a golf club head in accordance with one or more embodiments of the presently disclosed technology taken substantially along line D-D' of FIG. 17.
Figure 19:
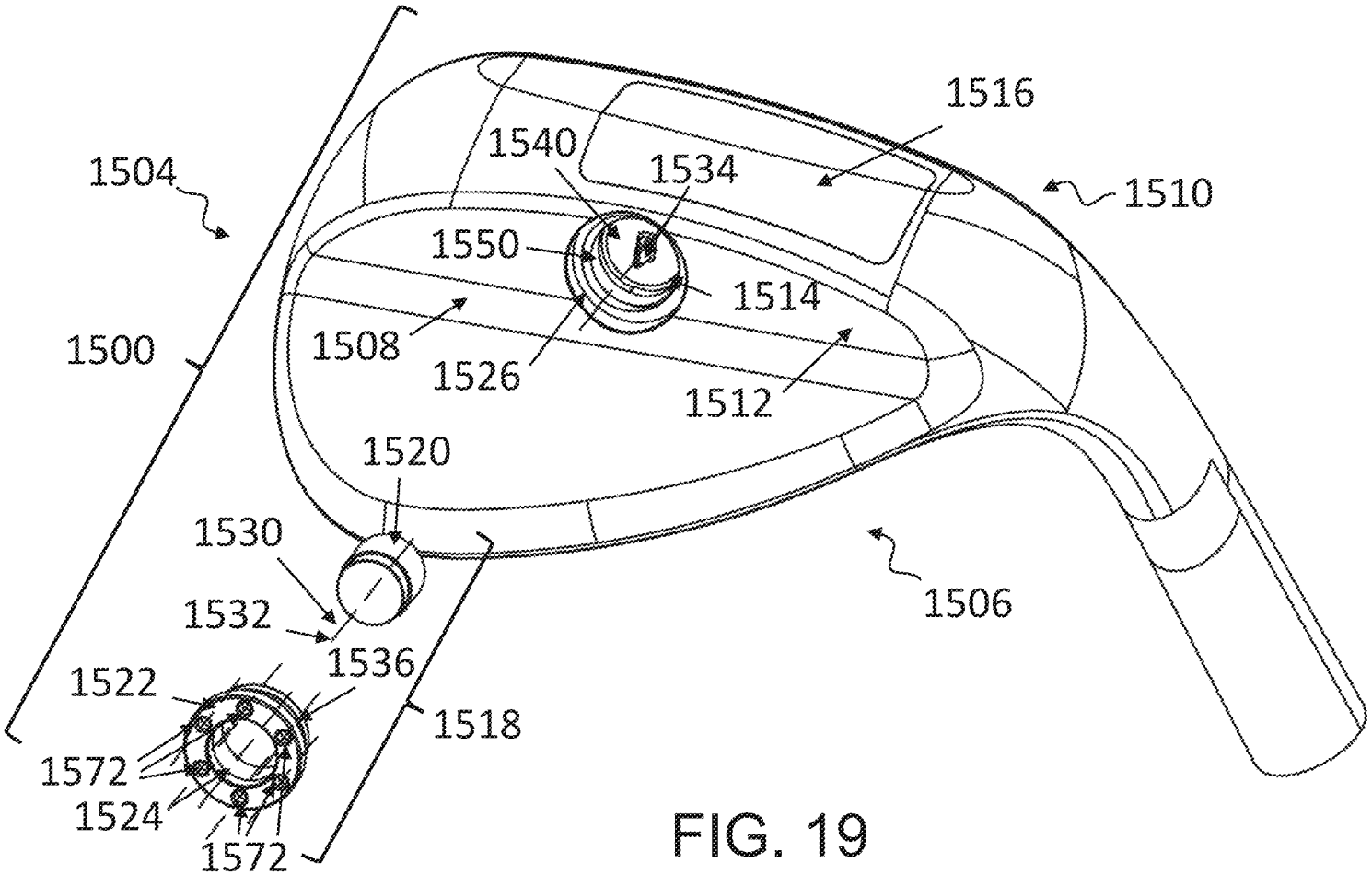
FIG. 19 is an exploded view of a golf club face in accordance with one or more embodiments of the presently disclosed technology.

FIGS. 15-19 illustrate golf club head 1500 in accordance with one or more embodiments of the presently disclosed technology. For example, FIG. 15 is a perspective view of golf club head 1500 in accordance with one or more embodiments of the presently disclosed technology. FIG. 16 is a perspective view of golf club head 1500 in accordance with one or more embodiments of the presently disclosed technology. FIG. 17 is a perspective view of golf club head 1500 in accordance with one or more embodiments of the presently disclosed technology. FIG. 18 is a cross-sectional view of golf club head 1500 in accordance with one or more embodiments of the presently disclosed technology taken substantially along line D-D' of FIG. 17. FIG. 19 is an exploded view of golf club head 1500 in accordance with one or more embodiments of the presently disclosed technology. Each of these figures may provide different views of the same or similar components and may be discussed together herein. Referring first to FIG. 15, golf club head 1500 may include striking face portion 1502, back portion (at least shown as back portion 1504 in FIG. 16), and/or removable weight assembly (at least shown as removable weight assembly 1518 in FIG. 16). Striking face portion 1502 and/or back portion (at least shown as back portion 1504 in FIG. 16) may be the same as, or substantially similar to, other striking face portions and back portions discussed herein.

Referring to FIG. 18, gutter 1508, back flange 1512, and/or sole 1516 may include removable weight assembly recess 1514, weight recess 1540, and/or fastening recess 1526. Removable weight assembly recess 1514 may receive at least a portion of removable weight assembly 1518. Removable weight assembly recess 1514 may include a first circumference. Removable weight assembly recess 1514 may be centered, or substantially centered, on golf club head 1500, gutter 1508, back flange 1512, and/or sole 1516. In some embodiments, removable weight assembly recess 1514 may be offset backward from a center of back flange 1512. Removable weight assembly recess 1514 may appear substantially circular looking directly into a bottom of removable weight assembly recess 1514. It should be appreciated that removable weight assembly recess 1514 may be otherwise shaped, sized, and/or dimensioned without departing from the spirit and scope of the presently disclosed technology. For example, removable weight assembly recess 1514 may be heelward, toeward, forward, and/or backward on golf club head 1500, gutter 1508, back flange 1512, and/or sole 1516. The bottom of removable weight assembly recess 1514 may be angled, curved, or otherwise shaped to receive and/or secure at least a portion of cover portion 1522 and/or removable weight 1520. Removable weight assembly recess 1514 may partially cover gutter 1508, back flange 1512, and/or sole 1516. One or more aspects of removable weight assembly recess 1514 may be the same as, or substantially similar to, other removable weight assembly recesses discussed herein.

Weight recess 1540 may receive at least a portion of removable weight 1520. Weight recess 1540 may be centered, or substantially centered, on removable weight assembly recess 1514. It should be appreciated that weight recess 1540 may be otherwise positioned without departing from the spirit and scope of the presently disclosed technology. For example, weight recess 1540 may be toeward, heelward, forward, and/or backward on, or of, removable weight assembly recess 1514. Weight recess 1540 may be set within removable weight assembly recess 1514. For example, removable weight assembly recess 1514 may be recessed a first distance. Weight recess 1540 may be recessed a second distance. The second distance may be larger than the first distance. In some embodiments, weight recess 1540 may be understood as being recessed within removable weight assembly recess 1514. It should be appreciated that weight recess 1540 may be otherwise shaped, sized, and/or dimensioned without departing from the spirit and scope of the presently disclosed technology. For example, the bottom of weight recess 1540 may be angled, curved, or otherwise shaped to receive and/or secure at least a portion of removable weight 1520. Here, looking into weight recess 1540, weight recess 1540 may appear substantially circular. Weight recess 1540 may include a second circumference. The second circumference may be smaller than the first circumference. This may prevent cover portion 1522 from slipping into weight recess 1540. Weight recess 1540 may include protrusion 1534. Protrusion 1534 may help secure removable weight 1520 in the locked configuration. Protrusion 1534 may prevent unintended movement and/or rotation of removable weight 1520 in the locked configuration. Protrusion 1534 may engage removable weight 120 thereby preventing rotation of removable weight 120 in the locked configuration. Weight recess 1540 may include threads 1550. One or more aspects of weight recess 1540 may be the same as, or substantially similar to, other weight recesses discussed herein.

Sole 1516 may be the same as, or substantially similar to, other soles discussed herein. Removable weight assembly 1518 may fit into removable weight assembly recess 1514 and/or weight recess 1540. Removable weight assembly 1518 may go onto portions of gutter 1508 and/or lower muscle portion 1510. For example, removable weight assembly 1518 may go onto gutter 1508, back flange 1512, and/or sole 1516. Removable weight assembly 1518 may include removable weight 1520 and/or cover portion 1522. Removable weight 1520 may appear substantially circular looking above removable weight 1520. Removable weight 1520 may be substantially cylindrical. Removable weight 1520 may include a first weight circumference and a second weight circumference. The first weight circumference may be smaller than the second weight circumference. The first weight circumference may allow removable weight 1520 to be flush with an outside of cover portion 1522 in a locked configuration. It should be appreciated that removable weight 1520 may be differently shaped, sized, and/or dimensioned without departing from the spirit and scope of the presently disclosed technology. Removable weight 1520 may be shaped, sized, and/or dimensioned to fit into weight recess 1540. Removable weight 1520 may include weight recess axis 1532 and/or recessed groove 1570. Fastening recess axis 1530 may be aligned with weight recess axis 1532. This may mean they are along the same line. Weight recess axis 1532 may be the same as, or substantially similar to, other weight recess axis discussed herein. Recessed groove 1570 may engage protrusion 1534 to prevent unwanted movement, including rotation of removable weight 1520 in a locked configuration. For example recessed groove 1570 may receive protrusion 1534. One or more aspects of removable weight assembly 1518 and/or removable weight 1520 may be the same as, or substantially similar to, other removable weight assemblies and/or removable weights discussed herein.

Cover portion 1522 may cover at least part of removable weight assembly recess 1514, removable weight 1520, and/or weight recess 1540 in the locked configuration. Cover portion 1522 may be substantially circular as viewed from above. Cover portion 1522 may be a hollow cylindrical shape. It should be appreciated that cover portion 1522 may be otherwise shaped, sized, and/or dimensioned without departing from the spirit and scope of the presently disclosed technology. Cover portion 1522 may fit into removable weight assembly recess 1514. Cover portion 1522 may include fastening recess axis 1530 and/or threads 1536. Fastening recess axis 1530 may be the same as, or substantially similar to, other fastening recess axes discussed herein. Threads 1536 may engage with threads 1550 to secure cover portion 1522 and/or removable weight 1520 to golf club head 1500. Threads 1536 may be on an exterior of cover portion 1522. Cover portion 1522 may include cover opening 1524. Cover opening 1524 may receive a portion of removable weight 1520. Cover opening 1524 may include a first cover opening circumference and a second cover opening circumference. The first cover opening circumference may be smaller than the second cover opening circumference. The first cover opening circumference may be substantially the same as the first weight circumference. The second cover opening circumference may be substantially the same as the second weight circumference. This may allow removable weight 1520 to be flush in the locked configuration. A part of cover portion 1522 may extend downward near cover opening 1524 to help fit into fastening recess 1526. This part extending downward may have the second circumference. Cover portion 1522 may include one or more recessions 1572 to receive a portion of a tool to fasten cover portion 1522 into the locked configuration. For example, the tool may be a six-pronged wrench to fasten cover portion 1522 where each prong corresponds to one or more recessions 1572. One or more aspects of cover portion 1522, cover opening 1524, threads 1536, and/or threads 1550 may be the same as, or substantially similar to, other cover portions, cover openings, and/or threads discussed herein.

Referring to FIGS. 16, 17, and 19, additional views of golf club head 1500 may provide additional views of golf club head 1500, back portion 1504, upper blade portion 1506, gutter 1508, lower muscle portion 1510, back flange 1512, removable weight assembly recess 1514, sole 1516, removable weight assembly 1518, removable weight 1520, cover portion 1522, cover opening 1524, fastening recess axis 1530, weight recess axis 1532, protrusion 1534, threads 1536, weight recess 1540, threads 1550, and/or recessions 1572.

Other than in at least some of the operating examples, or unless otherwise expressly specified, all of the numerical ranges, amounts, values and percentages such as those for amounts of materials, moment of inertias, center of gravity locations, loft, angles, various ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and appended claims are approximations that may vary depending upon the desired properties sought to be obtained by the presently disclosed technology. At the very least, and not as an attempt to limit the application of the doctrine of equivalents to the scope of the claims, each numerical parameter should at least be construed in light of the number of reported significant digits and by applying ordinary rounding techniques.

In some examples, substantially parallel may be defined to include zero degrees, or between zero degrees and one degree, or between zero degrees and two degrees, or between zero degrees and five degrees, or between zero degrees and ten degrees of deviation from being exactly parallel to the disclosed front surface. Substantially may be defined to be a value within 10% of the identified value.

Notwithstanding that the numerical ranges and parameters setting forth the broad scope of the presently disclosed technology are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While various embodiments of the disclosed technology have been described above, it should be appreciated these are examples only, and not limiting. Likewise, the various figures may depict an example configuration or structure to aid in understanding the features and functionality that can be included in the disclosed technology. The presently disclosed technology is not intended to be restricted to the illustrated example configurations and structures, and the desired features can be implemented with a variety of alternative configurations and structures. It may be apparent to one of skill in the art how alternative embodiments can be implemented to impart the desired features of the presently disclosed technology. Therefore, it will be understood that the appended claims are intended to cover all such modifications and embodiments, which would come within the spirit and scope of the presently disclosed technology.

While the presently disclosed technology may be described herein in terms of various exemplary embodiments, it should be understood that the various features described in any individual embodiment is not limited to its particular embodiment, and can be applied, whether alone or in combinations with features of other embodiments, to another embodiment, whether or not such an embodiment is described herein or described as part of a single embodiment. Thus, the breadth and scope of the presently disclosed technology should not be limited to any of the above-described exemplary embodiments.

Words, phrases, and their variations that are used herein, unless otherwise expressly stated, should be construed as open ended, not as limiting. For example, the term "include" should be read to mean "include, without limitation"; the term "example" should be read to mean the following provides exemplary instances, not an exhaustive or limiting list thereof; "a" or "an" should be read as meaning "at least one," "one or more" etc.; and "traditional," "normal," and similar terms should not be construed as limiting to a given time period, but should be read to encompass traditional, normal, like technologies that may be known now or at any future point; and a heel-to-toe direction should be read as meaning either the toe-to-heel direction or the heel-to-toe direction, a bottom-to-top direction should be read as meaning either the bottom-to-top direction or the top-to-bottom direction, and a back-to-front direction should be read as meaning either a back-to-front direction or a front-to-back direction. In addition, references herein to technologies that would be apparent or known to one of ordinary skill in the art includes such technologies that are apparent or known to one of ordinary skill in the art now or at any time in the future.

The presence of words and phrases such as "one or more," "at least," "not limited to," or other similar phrases shall not be read to necessarily mean that the narrower case is intended in instances where such broadening phrases may be absent. The presence of words such as "first," "second," or other similar words shall not be read to mean that there can only be one or two elements.

What is claimed is:

1. A golf club head, comprising:

a striking face portion;

a back portion comprise:

an upper blade portion extending backward from an upper portion of the striking face portion;

a gutter extending downward from the upper blade portion; and a lower muscle portion extending downward from the gutter, wherein the lower muscle portion comprises:

a back flange, wherein the back flange comprises:

a removable weight assembly recess;

a weight recess;

a fastening recess; and a fastening mechanism to fit into the fastening recess, wherein the fastening recess comprises a fastening recess axis along which the fastening mechanism is fastened; and a sole connecting a lower portion of the striking face portion to the back flange; and a removable weight assembly comprising:

a removable weight to fit into the removable weight assembly recess, wherein the weight recess comprises a weight recess axis along which the removable weight is placed, and wherein the fastening recess axis and the weight recess axis are substantially parallel; and a cover portion to at least partially cover the removable weight assembly recess in a locked configuration, wherein the cover portion comprises a cover opening, and wherein the fastening mechanism is configured to secure the cover portion in the locked configuration thereby securing the removable weight.

2. The golf club head of claim 1, wherein the removable weight comprises a metal.

3. The golf club head of claim 2, wherein the metal is one of a tungsten, steel, titanium, and aluminum.

4. The golf club head of claim 1, wherein the removable weight is a flat weight.

5. The golf club head of claim 1, wherein the cover portion is flush with surrounding portions of the golf club head in the locked configuration thereby providing a virtually indistinguishable golf club head from a traditional golf club head.

6. The golf club head of claim 1, wherein the weight recess comprises a protrusion to engage the removable weight thereby preventing rotation of the removable weight in the locked configuration.

7. The golf club head of claim 6, wherein the cover portion comprises threads to engage with corresponding threads in the weight recess.

8. A golf club head, comprising:

a striking face portion;

a back portion comprise:

an upper blade portion extending backward from an upper portion of the striking face portion;

a gutter extending downward from the upper blade portion; and a lower muscle portion extending downward from the gutter, wherein the lower muscle portion comprises:

a back flange, wherein the back flange comprises:

a removable weight assembly recess;

a first weight recess located toeward, wherein the first weight recess comprises a first position and a second position to receive a first removable weight; and a second weight recess located heelward, wherein the second weight recess comprises a third position and a fourth position to receive the first removable weight; and a sole connecting a lower portion of the striking face portion to the back flange; and a removable weight assembly comprising:

the first removable weight to fit into one of the first position, the second position, the third position, and the fourth position; and a cover portion to at least partially cover the removable weight assembly recess, the first weight recess, and the second weight recess in a locked configuration, wherein the cover portion comprises a cover opening.

9. The golf club head of claim 8, wherein the sole further comprises a fastening recess, wherein the golf club head further comprises a fastening mechanism to fit into the fastening recess, and wherein the fastening mechanism is configured to secure the cover portion in the locked configuration thereby securing the first removable weight.

10. The golf club head of claim 9, wherein the fastening recess is located between the first weight recess and the second weight recess.

11. The golf club head of claim 8, wherein the removable weight assembly further comprises a second removable weight to fit into one of the first position, the second position, the third position, and the fourth position.

12. The golf club head of claim 11, wherein the first removable weight and the second removable weight comprise a metal.

13. The golf club head of claim 12, wherein the metal is one of a tungsten, steel, titanium, and aluminum.

14. The golf club head of claim 11, wherein the first removable weight is a first weight, and the second removable weight is a second weight, wherein the first weight is different from the second weight.

15. A golf club head, comprising:

a striking face portion;

a back portion comprise:

an upper blade portion extending backward from an upper portion of the striking face portion;

a gutter extending downward from the upper blade portion; and a lower muscle portion extending downward from the gutter, wherein the lower muscle portion comprises:

a back flange, wherein the back flange comprises:

a removable weight assembly recess; and a weight recess; and a sole connecting a lower portion of the striking face portion to the back flange; and a removable weight assembly comprising:

a removable weight to fit into the weight recess, wherein the removable weight is cylindrical; and a cover portion to at least partially cover the removable weight assembly recess in a locked configuration, wherein the cover portion is circular, and wherein the cover portion comprises:

a cover opening to receive at least a portion of the removable weight; and threads to engage with corresponding threads in the weight recess to secure the cover portion to the golf club head.

16. The golf club head of claim 15, wherein the weight recess comprises a protrusion to engage the removable weight thereby preventing rotation of the removable weight in the locked configuration.

17. The golf club head of claim 16, wherein the removable weight comprises a recessed groove to engage the protrusion.

18. The golf club head of claim 15, wherein the removable weight comprises a metal.

* * * * *